US009567177B2

(12) United States Patent
Sugitani et al.

(10) Patent No.: US 9,567,177 B2
(45) Date of Patent: Feb. 14, 2017

(54) PAPER DISCHARGE DEVICE

(71) Applicant: RISO KAGAKU CORPORATION, Minato-ku, Tokyo (JP)

(72) Inventors: Hiroshi Sugitani, Tsukuba (JP); Akihiro Tsumura, Tsukuba (JP); Tetsunori Saito, Tsukuba (JP)

(73) Assignee: RISO KAGAKU CORPORATION, Minato-Ku, Tokyo (JP)

( * ) Notice: Subject to any disclaimer, the term of this patent is extended or adjusted under 35 U.S.C. 154(b) by 0 days.

(21) Appl. No.: 14/693,554

(22) Filed: Apr. 22, 2015

(65) Prior Publication Data

US 2015/0344254 A1 Dec. 3, 2015

(30) Foreign Application Priority Data

May 30, 2014 (JP) ..... 2014-111914

(51) Int. Cl.
*B65H 29/14* (2006.01)
*B65H 31/02* (2006.01)
(Continued)

(52) U.S. Cl.
CPC ..... *B65H 29/14* (2013.01); *B65H 29/52* (2013.01); *B65H 31/02* (2013.01); *B65H 43/00* (2013.01); *B65H 2301/133* (2013.01); *B65H 2301/4212* (2013.01); *B65H 2404/1421* (2013.01); *B65H 2404/14211* (2013.01); *B65H 2404/6112* (2013.01); *B65H 2404/63* (2013.01); *B65H 2404/64* (2013.01); *B65H 2511/10* (2013.01); *B65H 2511/13* (2013.01); *B65H 2511/214* (2013.01); *B65H 2511/216* (2013.01); *B65H 2511/30* (2013.01); *B65H 2511/413* (2013.01); *B65H 2601/251* (2013.01); *B65H 2801/06* (2013.01)

(58) Field of Classification Search
CPC ..... B65H 43/00; B65H 31/02; B65H 29/14; B65H 29/52; B65H 2404/1421; B65H 2404/14211; B65H 2404/63; B65H 2601/251; B65H 2511/413
See application file for complete search history.

(56) References Cited

U.S. PATENT DOCUMENTS 6,390,466 B1 * 5/2002 Sanmiya ..... B65H 33/08 270/58.08
8,128,085 B2 * 3/2012 Seki ..... B65H 29/125 271/209

(Continued)

FOREIGN PATENT DOCUMENTS

JP 03088667 A * 4/1991
JP 10246998 A 9/1998
JP 2008110845 A * 5/2008

*Primary Examiner* — Patrick Cicchino
(74) *Attorney, Agent, or Firm* — Holtz, Holtz & Volek PC

(57) ABSTRACT

When a face of a paper sheet to be discharged on which an image is formed faces downward, a paper discharge device divides an image region of image data on the paper sheet to be discharged into areas along a discharge direction, detects an area in which maximum image density for each divided area is higher than or equal to a specified threshold, and controls a discharge angle so that the detected area does not come into contact with a stacked paper sheet until the paper sheet to be discharged has been discharged from a discharge roller.

6 Claims, 21 Drawing Sheets

(51) Int. Cl.
*B65H 29/52* (2006.01)
*B65H 43/00* (2006.01)

(56) References Cited

U.S. PATENT DOCUMENTS

| | | | | |
|---|---|---|---|---|
| 2015/0274472 | A1* | 10/2015 | Momiyama ..... | B65H 29/70<br>271/207 |
| 2015/0344258 | A1* | 12/2015 | Tsumura ..... | B65H 31/02<br>271/176 |
| 2016/0176672 | A1* | 6/2016 | Lochbichler ..... | B65H 39/10<br>270/58.04 |

* cited by examiner

| PAPER SHEET SIZE | A3 VERTICAL | B4 VERTICAL | A4 VERTICAL | A4 HORIZONTAL | B5 VERTICAL | B5 HORIZONTAL |
|---|---|---|---|---|---|---|
| THE NUMBER OF STACKED SHEETS | BASIC DISCHARGE ANGLE | | | | | |
| 0～200 | θ00 | θ10 | θ20 | θ30 | θ40 | θ50 |
| 201～400 | θ01 | θ11 | θ21 | θ31 | θ41 | θ51 |
| 401～600 | θ02 | θ12 | θ22 | θ32 | θ42 | θ52 |
| 601～800 | θ03 | θ13 | θ23 | θ33 | θ43 | θ53 |
| 801～1000 | θ04 | θ14 | θ24 | θ34 | θ44 | θ54 |

F I G. 5 A

| PAPER SHEET SIZE | A3 VERTICAL | B4 VERTICAL | A4 VERTICAL | A4 HORIZONTAL | B5 VERTICAL | B5 HORIZONTAL |
|---|---|---|---|---|---|---|
| THE NUMBER OF STACKED SHEETS | BASIC DISCHARGE ANGLE | | | | | |
| 0～200 | 85.6 | 80.9 | 73.5 | 67.9 | 60 | 55.1 |
| 201～400 | 90.5 | θ11 | θ21 | θ31 | θ41 | θ51 |
| 401～600 | 95.9 | θ12 | θ22 | θ32 | θ42 | θ52 |
| 601～800 | 101.8 | θ13 | θ23 | θ33 | θ43 | θ53 |
| 801～1000 | 108 | θ14 | θ24 | θ34 | θ44 | θ54 |

F I G. 5 B

| AREA | CORRECTION VALUE |
|---|---|
| 1 | α1 |
| 2 | α2 |
| 3 | α3 |
| 4 | α4 |
| 5 | α5 |
| 6 | α6 |
| 7 | α7 |

| AREA | CORRECTION VALUE |
|---|---|
| 1 | 16.4 |
| 2 | 15.1 |
| 3 | 13.6 |
| 4 | 11.8 |
| 5 | 9.7 |
| 6 | 7.1 |
| 7 | 4 |

| AREA | CORRECTION VALUE |
|---|---|
| 1 | $\alpha$163 |
| 2 | $\alpha$164 |

| AREA | CORRECTION VALUE |
|---|---|
| 1 | 25.8 |
| 2 | 12.8 |

| PAPER SHEET KIND | DENSITY THRESHOLD |
|---|---|
| PLAIN PAPER | 8 |
| MATTE PAPER | 12 |
| THIN PAPER | 6 |
| OTHERS | 10 |

FIG. 9

| AREA | CORRECTION VALUE | IMAGE DENSITY | THRESHOLD | JUDGEMENT |
|---|---|---|---|---|
| 1 | α1 | 0 | 8 | ○ |
| 2 | α2 | 4 | ↓ | ○ |
| 3 | α3 | 10 | ↓ | × |
| 4 | α4 | | ↓ | |
| 5 | α5 | | ↓ | |
| 6 | α6 | | ↓ | |
| 7 | α7 | | ↓ | |

FIG. 12A

| AREA | CORRECTION VALUE | IMAGE DENSITY | THRESHOLD | JUDGEMENT |
|---|---|---|---|---|
| 1 | α1 | | 8 | |
| 2 | α2 | | ↓ | |
| 3 | α3 | | ↓ | |
| 4 | α4 | 5 | ↓ | ○ |
| 5 | α5 | 10 | ↓ | × |
| 6 | α6 | 12 | ↓ | × |
| 7 | α7 | 12 | ↓ | × |

FIG. 12B

PAPER DISCHARGE DEVICE

CROSS-REFERENCE TO RELATED APPLICATION

This application is based upon and claims the benefit of priority of the prior Japanese Patent Application No. 2014-111914, filed on May 30, 2014, the entire contents of which are incorporated herein by reference.

BACKGROUND OF THE INVENTION

Field of the Invention

The embodiments discussed herein are related to a technique for preventing deterioration in image quality due to rubbing between paper sheets with respect to a paper discharge device.

Description of the Related Art

With respect to a paper discharge device, various techniques have been developed for preventing misalignment of discharged paper sheets when paper sheets are stacked. When contact between a paper sheet and a discharge roller is released and the paper sheet is discharged in a not-in-contact state with stacked paper sheets, since the paper sheets fall freely and reach the stacked paper sheets, alignment of discharged paper sheets deteriorates. Therefore, a paper discharge device is proposed in which a discharge angle is made small so that the front end of a paper sheet to be discharged comes into contact with stacked paper sheets and then the paper sheet is placed on the paper sheet. FIGS. 18A-18C, and FIGS. 19A and 19B illustrate examples of such a discharge device.

FIG. 18A is a diagram illustrating how a paper sheet is discharged in a state in which there are no stacked paper sheets. Note that in regard to direction, in line with movement of the paper sheet 200 to be discharged, the rightward direction in the figure and the leftward direction in the figure are referred to as the upstream direction and the downstream direction, respectively.

By means of a discharge roller pair 104, the paper sheet 200 is discharged on a paper discharge tray 102 at a discharge angle such that the paper sheet 200 is directed downward to a downstream side in the S direction. The discharge angle is determined by an inclination of the discharge roller pair 104, etc. The front end of the paper sheet 200 to be discharged begins to come into contact with the paper discharge tray 102 while the paper sheet 200 is conveyed by means of the discharge roller pair 104.

As illustrated in FIG. 18B, when there are a few stacked paper sheets 210, the front end of the paper sheet 200 to be discharged begins to come into contact with the uppermost face of the stacked paper sheets 210 at almost the same position as that in FIG. 18A. The length between a contact start position and the front end position of the stacked paper sheets 210 is referred to as R, and R is the contact length over which the paper sheet 200 to be discharged contacts the uppermost face of the stacked paper sheets 210 until the paper sheet 200 to be discharged has been completely discharged.

As illustrated in FIG. 18C, as the stacked amount (the number of stacked sheets) of stacked paper sheets 210 increases, the contact start position of the front end of the paper sheet 200 to be discharged moves to an upstream side. Therefore, the contact length R becomes greater as compared with that when there are fewer stacked paper sheets 210, and the portion of the uppermost paper sheet of the stacked paper sheets 210 that is pushed out in the T direction increases by the paper sheet 200 to be discharged. The portion that is pushed out is not constant, which might deteriorate alignment of discharged paper sheets.

FIGS. 19A and 19B are diagrams illustrating how alignment of discharged paper sheets deteriorates when the size of the paper sheet 200 is larger. For example, FIG. 19A illustrates a case in which the paper sheet 200 is A4 size (210 mm×297 mm, as defined by ISO216), and FIG. 19B illustrates a case in which the paper sheet 200 is A3 size (297 mm×420 mm, defined by ISO216). When the paper sheet 200 is A3 size, the contact length R becomes greater and the contact time between the paper sheet 200 to be discharged and the uppermost face of the stacked paper sheets 210 becomes longer as compared with those when the paper sheet 200 is A4 size. Therefore, when the size of the paper sheet 200 becomes larger even though the stacked amount is the same, alignment of discharged paper sheets might further deteriorate.

In order to solve the problem that has been described in FIGS. 18A-18C, wherein the contact start position moves to the upstream side when the stacked amount increases, a paper discharge device is proposed which is configured to lower the paper discharge tray according to the stacked amount (For example, Japanese Laid-open Patent Publication No. H10-246998).

FIGS. 20A and 20B illustrate examples of such a paper discharge device. FIG. 20A illustrates a state in which the stacked amount of stacked sheets 210 is small, and FIG. 20B illustrates a state in which the stacked amount of stacked paper sheets 210 is large. As illustrated in FIG. 20B, a paper discharge device 150 detects an increase in the stacked height of stacked paper sheets 210 and lowers the paper discharge tray 102 by using a motor etc. by the increased amount. Thus, the contact length R may be made approximately constant regardless of the stacked amount of stacked paper sheets 210, and deterioration in alignment of discharged paper sheets due to the influence of the stacked amount may be prevented.

SUMMARY OF THE INVENTION

By adopting a configuration for bringing a paper sheet to be discharged into contact with stacked paper sheets, paper sheet alignment may be stabilized by preventing scattering of paper sheets to be discharged; however, there arises a problem in which staining is generated by rubbing a print image due to contact during discharge. In particular, when a portion with a high image density on a paper sheet is rubbed, it is more likely to generate staining. It is required to prevent degradation in image quality due to rubbing while ensuring stability in paper sheet alignment.

In view of the above problem, an aspect of the invention of the present application is directed to provision of a paper discharge device that prevents quality degradation of printed matter due to rubbing during paper discharge.

In order to attain the above objective, an aspect of the invention of the present application is directed to a paper discharge device that discharges by using a discharge roller a paper sheet on which an image is formed according to image data and stacks thereon the discharged paper sheet, and the paper discharge device includes a discharge angle adjustment unit that adjusts a discharge angle of a paper sheet that is discharged by the discharge roller, and a control unit that, when a face of a paper sheet to be discharged on which an image is formed faces downward, divides an image region of image data on the paper sheet to be discharged into areas along a discharge direction, detects an area in which a maximum image density related to the formed image for each divided area is higher than or equal to a specified threshold, and controls the discharge angle adjustment unit so that a discharge angle becomes a specific discharge angle such that the detected area is prevented from coming into contact with a stacked paper sheet until the paper sheet to be discharged has been discharged from the discharge roller.

According to an aspect of the invention of the present application, when the face on which an image is formed is put face down, since the discharge angle is set so that a high-density area that is formed on a paper sheet to be discharged does not rub the back face of a stacked paper sheet, it is possible to provide a discharge device that prevents quality degradation of printed matter due to rubbing during paper discharge.

BRIEF DESCRIPTION OF THE DRAWINGS

FIG. 5A is a table illustrating a configuration example of a stacked amount table.

FIG. 5B is a table illustrating a specific example of the stacked amount table.

FIG. 9 is a table illustrating an example of a density threshold table.

FIG. 12A is a table illustrating specific examples of correction value determination in a face-down situation.

FIG. 12B is a table illustrating specific examples of correction value determination in a face-up situation.

DETAILED DESCRIPTION OF THE PREFERRED EMBODIMENTS

Figure 1:
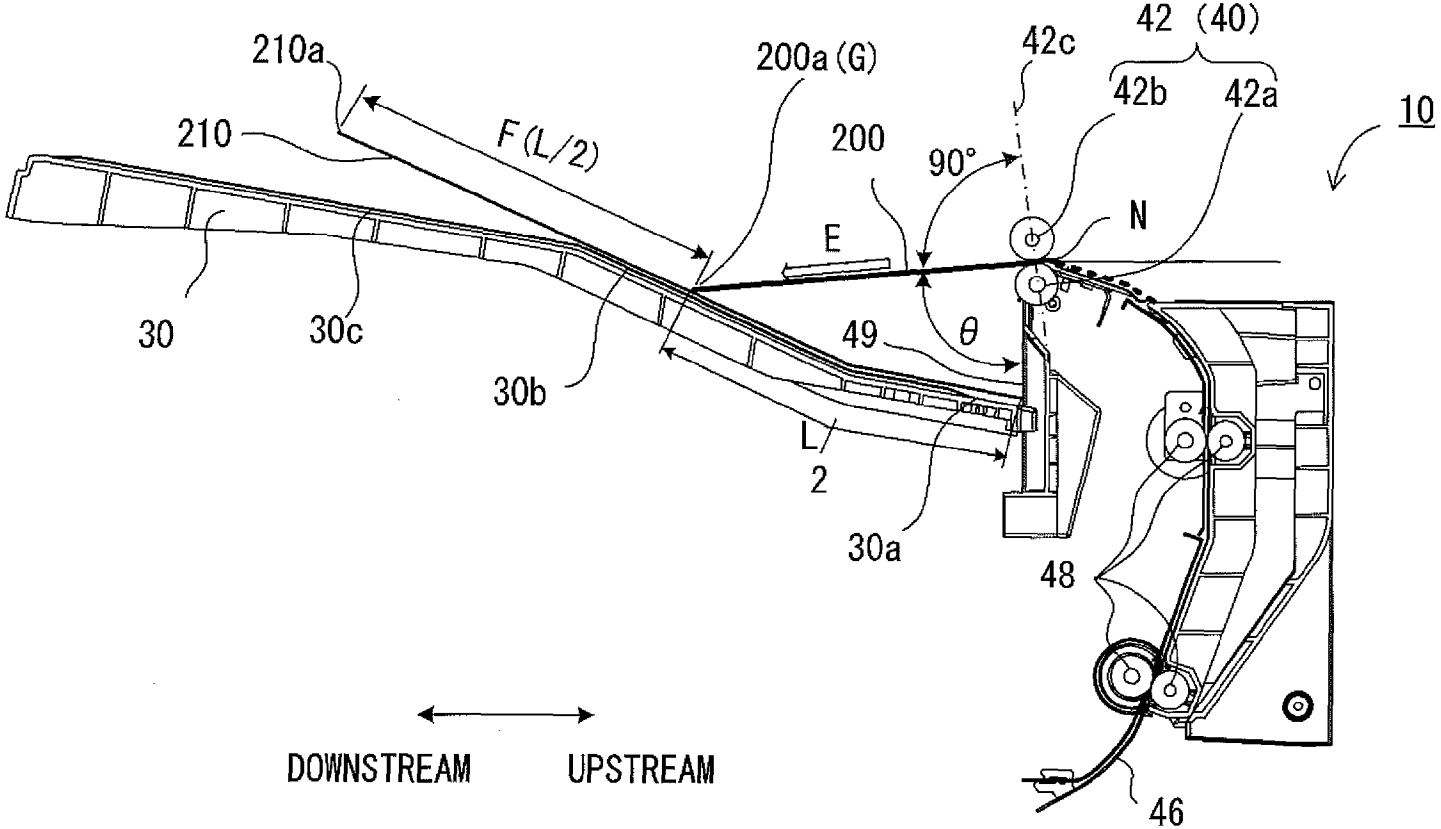
FIG. 1 is a side view of a paper discharge device to which embodiments of the present invention are applied and which illustrates a main configuration related to paper discharge.

Hereinafter, embodiments of the present invention will be described with reference to the drawings. FIG. 1 is a side view of a paper discharge device 10 to which the embodiments of the present invention are applied and which illustrates a main configuration related to paper discharge. The paper discharge device 10 is integrally provided in an image forming device 1.

The image forming device 1, described briefly, includes a printing unit (not shown) configured to create information such as a character, an image, etc. (correctively referred to as image information) on a paper sheet, a paper sheet storage unit (not shown) configured to store paper sheets to be fed to the printing unit, a conveying unit (not shown) configured to convey a paper sheet inside the device, and the paper discharge device 10 configured to discharge a paper sheet on which an image is formed, etc.

The paper discharge device 10 includes a paper discharge tray 30, a discharge roller unit 40, a discharged paper conveying path 46, conveying rollers 48, and an abutting face 49. In regard to direction in the drawing, in line with movement of a paper sheet 200 to be discharged, the rightward direction in the figure and the leftward direction in the figure are referred to as the upstream direction and the downstream direction, respectively. The ends on the downstream side and the ends on the upstream side of the paper sheet 200 and stacked paper sheets 210 are referred to as front ends and rear ends, respectively.

The paper discharge tray 30 is configured to stack thereon and hold the paper sheet 200 that is discharged from the discharge roller unit 40. The paper discharge tray 30 includes a first face 30*a*, a second face 30*b*, and a third face 30*c*, in this order from the upstream side, as faces on which the paper sheet 200 is placed.

The discharge roller unit 40 is configured to discharge the paper sheet 200 that has been conveyed from the image forming device 1 to the paper discharge tray 30. The discharge roller unit 40 includes one discharge roller pair 42 that conveys the paper sheet 200 by sandwiching it from above and below, and a discharge angle adjustment unit 44 that changes the angle of the discharge roller pair 42. The discharge angle adjustment unit 44 changes the angle of the discharge roller pair 42 so that the paper sheet 200 is discharged at a specified discharge angle (also referred to as a paper discharge angle). Details of the discharge angle adjustment unit 44 will be described in FIGS. 13 and 14.

The discharge roller pair 42 is configured to discharge a paper sheet that has been conveyed, and includes a set of a lower drive roller 42*a* and an upper driven roller 42*b*. The driven roller 42*b* is pressed against the drive roller 42*a* by means of a spring, etc., with a specified force. The drive roller 42*a* is rotated by means of a drive motor (not shown) and a transmission system from the drive motor.

The discharged paper conveying path 46 is a path for the paper sheet 200 which is provided to guide the paper sheet 200 that has been sent from the printing unit of the image forming device 1 to the discharge roller pair 42. The conveying rollers 48 are appropriately provided on the discharged paper conveying path 46, and transfer the paper sheet 200 to the discharge roller pair 42 by sandwiching the paper sheet 200 with one pair of rollers. The abutting face 49 is a face on which the rear ends of stacked paper sheet 210 abut. Here, it is assumed that the abutting face 49 is a plane in the vertical direction.

FIG. 1 illustrates a state in which the front end 200*a* of the paper sheet 200 begins to come into contact with a stacked paper sheet 210 in a state in which the stacked amount (the number of stacked sheets) of the stacked paper sheets 210 is small. The front end 200*a* of the paper sheet 200 that has been discharged from the discharge roller pair 42 comes into contact with the stacked paper sheet 210 in a state in which the rear end 200*b* (not shown) of the paper sheet 200 has not yet reached the nip point N of the discharge roller pair 42.

The angle between the discharge direction E of the paper sheet 200 and the abutting face 49 is referred to as the discharge angle θ, and the range from the contact start position G between the front end 200*a* of the paper sheet 200 and the uppermost face of the stacked paper sheets 210 to the front end 210*a* of the stacked paper sheet 210 is referred to as the contact range F in which the paper sheet 200 comes into contact with the stacked paper sheet 210 during discharge.

The contact start position G is adjusted according to the discharge angle θ that is determined according to the angle of the discharge roller pair 42, etc. The discharge angle that sets the contact start position G at which the front end of a paper sheet to be discharged first comes into contact with a stacked paper sheet at a specified position on the stacked paper sheet in the discharge direction is referred to as the basic discharge angle θa. In FIG. 1, the contact start position G is positioned at the center of the stacked paper sheet 210 in the discharge direction, that is, assuming that L is the total length of the paper sheet along the discharge direction, the contact start position G is positioned at L/2. Assuming that the paper sheet size is A3 (297 mm×420 mm, as defined by ISO216) and that the discharge direction is the long direction, then L/2=210.

The contact start position G is corrected by means of angle adjustment of the discharge roller pair 42 according to the area of maximum image density that will be described later, etc. with reference to the L/2 position. Note that the reference position is not limited to L/2.

The line that passes through the centers of the drive roller 42*a* and the driven roller 42*b* is referred to as the roller inclination line 42*c*, and it is assumed that the direction orthogonal (90°) to the roller inclination line 42*c* matches the discharge direction E of the paper sheet 200. The discharge direction E may deviate from the direction orthogonal (90°) to the roller inclination line 42*c*, because the discharge direction E is affected by the pressing force and the friction coefficient of the discharge roller pair 42. However, since the discharge direction E is dominantly determined by the angle of the discharge roller pair 42, it is hereinafter assumed that the discharge direction E changes according to the inclination angle of the roller inclination line 42*c*.

Note that the discharge angle adjustment unit 44 may adjust the discharge angle θ also by means other than the discharge roller pair 42, which will be described in FIGS. 15A and 15B, FIGS. 16A and 16B, and FIGS. 17A and 17B.

According to the paper discharge method as illustrated in FIG. 1, in which the front end of the paper sheet 200 is brought into contact with the stacked paper sheet 210, alignment of discharged paper sheets is stabilized because the paper sheet 200 does not fall freely so as to be stacked on the stacked paper sheet 210. On the other hand, by bringing the paper sheets into contact with each other, the paper sheets are rubbed against each other, and the print image quality might deteriorate. This is because ink has not been completely dried when the paper sheet is discharged.

Therefore, in this embodiment, the contact start position G is maintained at a fixed position by setting the discharge angle θ according to the stacked amount and the paper sheet size and alignment of discharged paper sheets is stabilized, and in addition, deterioration in the print image quality is prevented by correcting according to print conditions etc. the discharge angle θ that has been set according to the stacked amount and the paper sheet size. First, the principle for preventing deterioration in print image quality according to this embodiment will be described with reference to FIGS. 2A-2C and FIGS. 3A-3C.

Figure 2A:
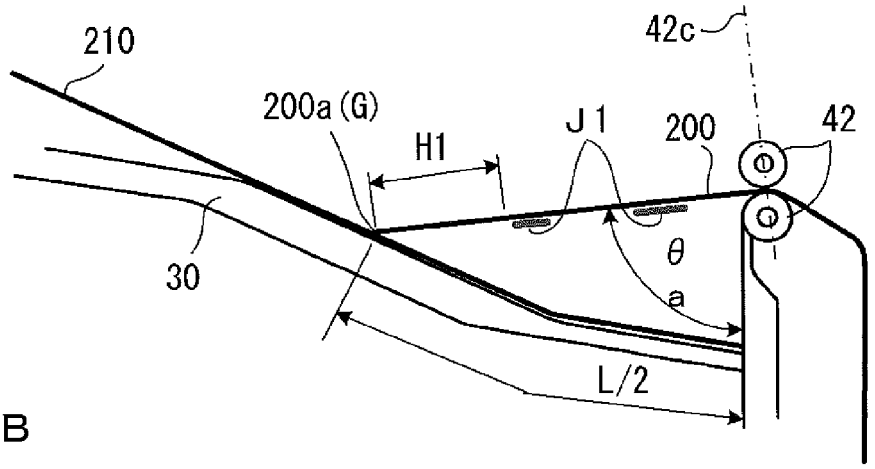
FIG. 2A is a first diagram illustrating a principle for preventing quality degradation in a face-down situation.
Figure 2B:
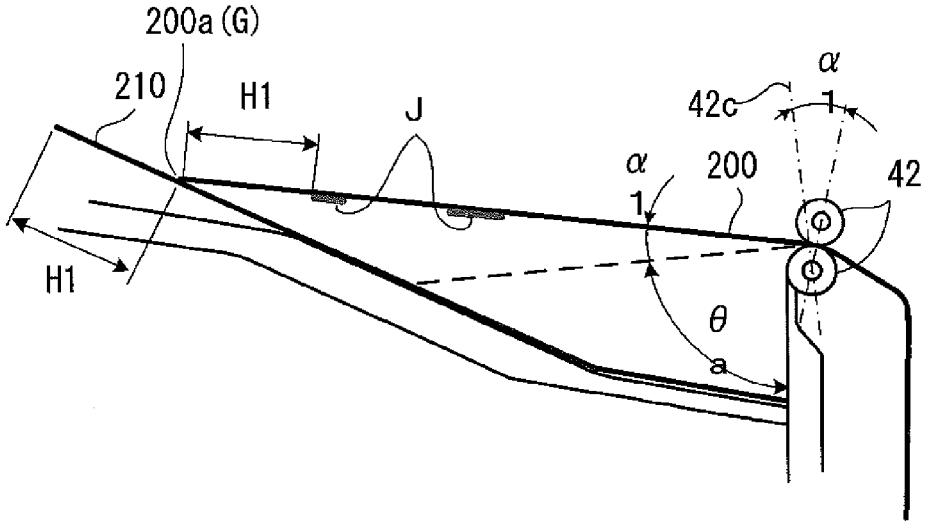
FIG. 2B is a second diagram illustrating a principle for preventing quality degradation in a face-down situation.
Figure 2C:
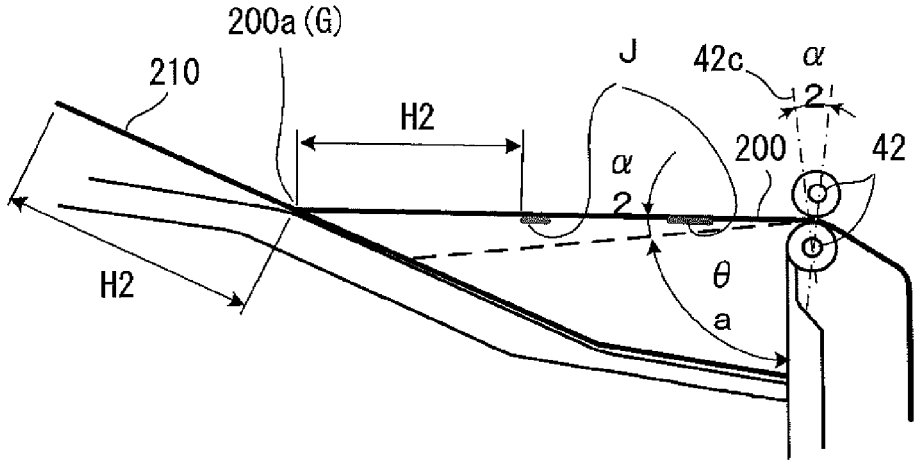
FIG. 2C is a third diagram illustrating a principle for preventing quality degradation in a face-down situation.

FIGS. 2A-2C illustrate cases in which the orientation of a print face to be discharged is face-down. FIG. 2A illustrates a case as illustrated in FIG. 1 in which the contact start position G is located at the reference position (L/2) of the stacked paper sheet 210 and the discharge angle is ea. In the image that is printed on the paper sheet 200, a portion in which the image density is higher than or equal to a specified density (threshold) is referred to as J.

Here, the distance from the front end 200*a* of the sheet 200 to be discharged to high-density portion J that is located closest to the front end 200*a* is referred to as distance H1. When it is assumed that H1<L/2, since portion J moves to the downstream side while rubbing the stacked paper sheet 210 until discharge of the paper sheet 200 has been completed, high-density portion J may be stained.

In order to prevent the portion from being stained, the paper sheet 200 needs to be discharged in such a manner that high-density portion J does not rub the stacked paper sheet 210.

That is, as illustrated in FIG. 2B, it is necessary to bring the contact start position G of the paper sheet 200 to a position at which the distance from the front end 210*a* of the stacked paper sheet 210 is shorter than H1. The discharge angle θ is changed by α1 so that the contact start position G is located at the position at which the distance from the front end 210*a* is H1. The discharge angle θ becomes θa+α1. The discharge roller pair 42 is rotated in the clockwise direction by α1, and the discharge angle θ is changed by α1.

FIG. 2C illustrates a case in which high-density portion J is positioned relatively closer to the rear end in comparison with the case in FIG. 2B, that is, the case in which the distance is greater than H1, namely, H2. In this case, staining due to rubbing may be prevented even when the discharge angle θ is θa+α1; however, since alignment accuracy of discharged paper sheets deteriorates as the contact start position G becomes positioned closer to the front end, the discharge angle θ is set to θa+α2, which corresponds to H2. The discharge angle is corrected upward by α2 in comparison with the case in FIG. 2A, and the discharge angle θ becomes θa+α2. The discharge roller pair 42 is rotated in the clockwise direction by α2. α1 and α2 are referred to as correction values.

Figure 3A:
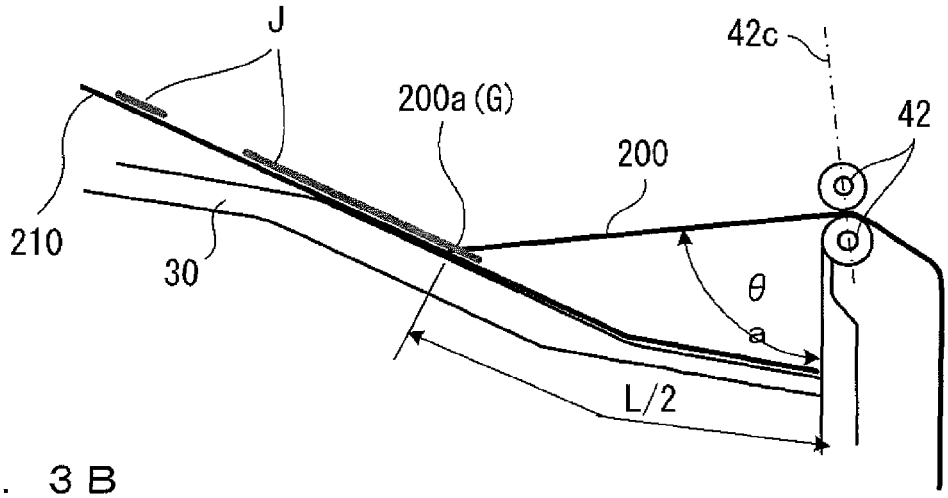
FIG. 3A is a first diagram illustrating a principle for preventing quality degradation in a face-up situation.
Figure 3B:
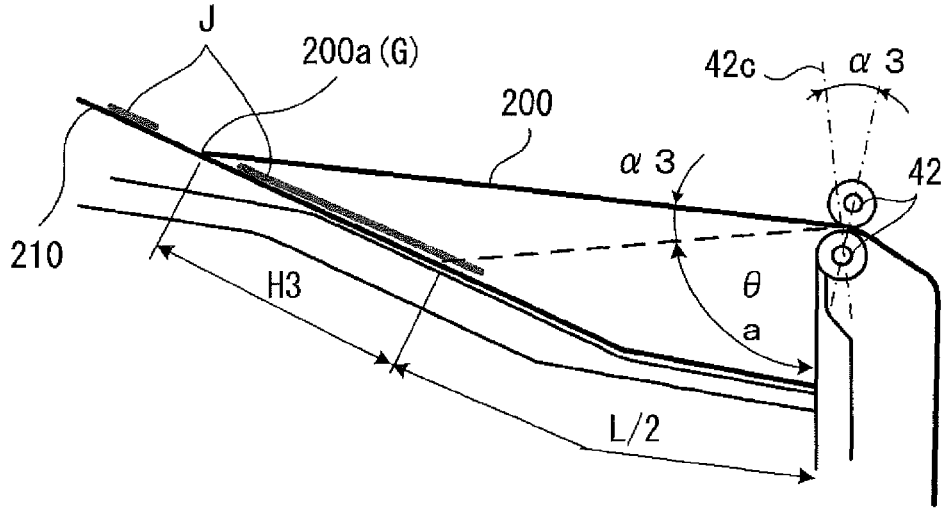
FIG. 3B is a second diagram illustrating a principle for preventing quality degradation in a face-up situation.
Figure 3C:
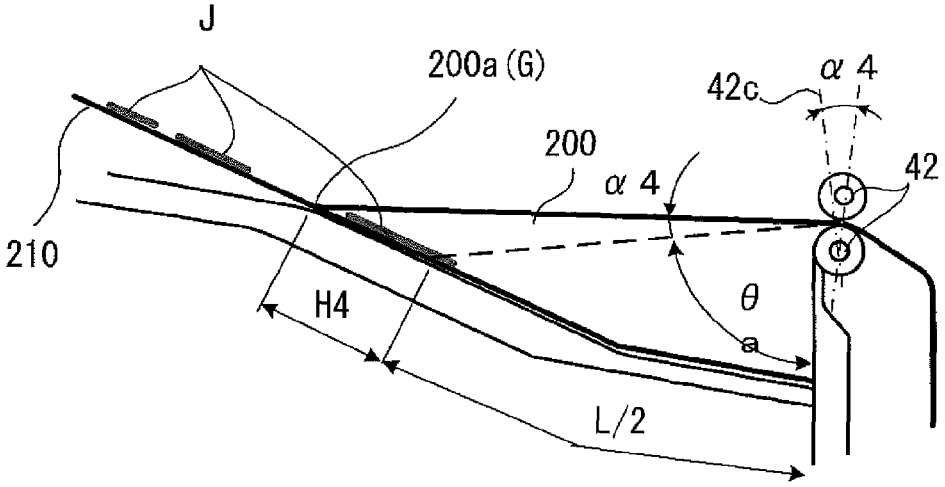
FIG. 3C is a third diagram illustrating a principle for preventing quality degradation in a face-up situation.

FIGS. 3A-3C illustrate cases in which the orientation of a print face to be discharged is face-up. FIG. 3A illustrates a case as illustrated in FIG. 1 in which the contact start position G is located at the reference position (L/2) of the stacked paper sheet 210 and the discharge angle is θa. In the image which is printed on the stacked paper sheet 210, a portion in which the image density is higher than or equal to the predetermined density is referred to as J.

In a face-up situation, high-density portion J on the stacked paper sheet 210 might be stained by being rubbed by the front end 200*a* of the paper sheet 200 to be discharged. In contrast to a face-down situation, the print density on the paper sheet 200 to be discharged becomes irrelevant. Since it is considered that a rubbing force applied to the stacked paper sheet 210 becomes largest just after the front end 200*a* of the paper sheet 200 collides with the stacked paper sheet 210, the print image quality degrades when high-density portion J exists in a contact portion.

Note that after the front end 200*a* of the paper sheet 200 achieves contact, the front side of the paper sheet 200 moves in the downstream direction while rubbing the print face of the stacked paper sheet 210. Since the rubbing force at that time is weaker than the force at collision, it is considered that the possibility of leading to staining is relatively low. Therefore, in this embodiment, a rubbed state after contact is not taken into consideration.

Therefore, in a face-up situation, when the discharge angle θ is adjusted so that the front end 200*a* of the paper sheet 200 begins to come into contact with the stacked paper sheet 210 in a region thereof where there are no high-density portions J, degradation in print image quality may be prevented.

FIG. 3B illustrates an example in which the discharge angle θ is set so that the contact start position G corresponds to a region in which there are no high-density portions J. The region in which there are no high-density portions J is a first region in which a high-density portion J does not exist from the reference position (L/2) of the stacked paper sheet 210 to the front end 210*a* (not shown) of the stacked paper sheet 210. The region is positioned at a distance H3 from the reference position of the stacked paper sheet 210.

Note that when the contact start position G is located at the upstream side from the center, since the angle of the paper sheet 200 with respect to the stacked paper sheet 210 becomes steep and the paper sheet 200 might be folded etc., it is assumed that the contact start position G is not set at the upstream side from the center.

The discharge angle θ becomes θa+α3 so that the contact start position G is positioned at H3. As compared with the case in FIG. 3A, the discharge angle is corrected upward by α3, and the discharge angle θ becomes θa+α3. The discharge roller pair 42 is rotated in the clockwise direction by α3.

FIG. 3C illustrates a case in which a region in which there are no high-density portions J exists at a position (H4) closer to the center as compared with the case in FIG. 3B. The discharge angle is corrected upward by α4 in comparison with the case in FIG. 3A so that the contact start position G is located at a region where a high-density portion J does not exist. The discharge angle θ becomes θa+α4. The discharge roller pair 42 is rotated in the clockwise direction by α4.

Figure 4:
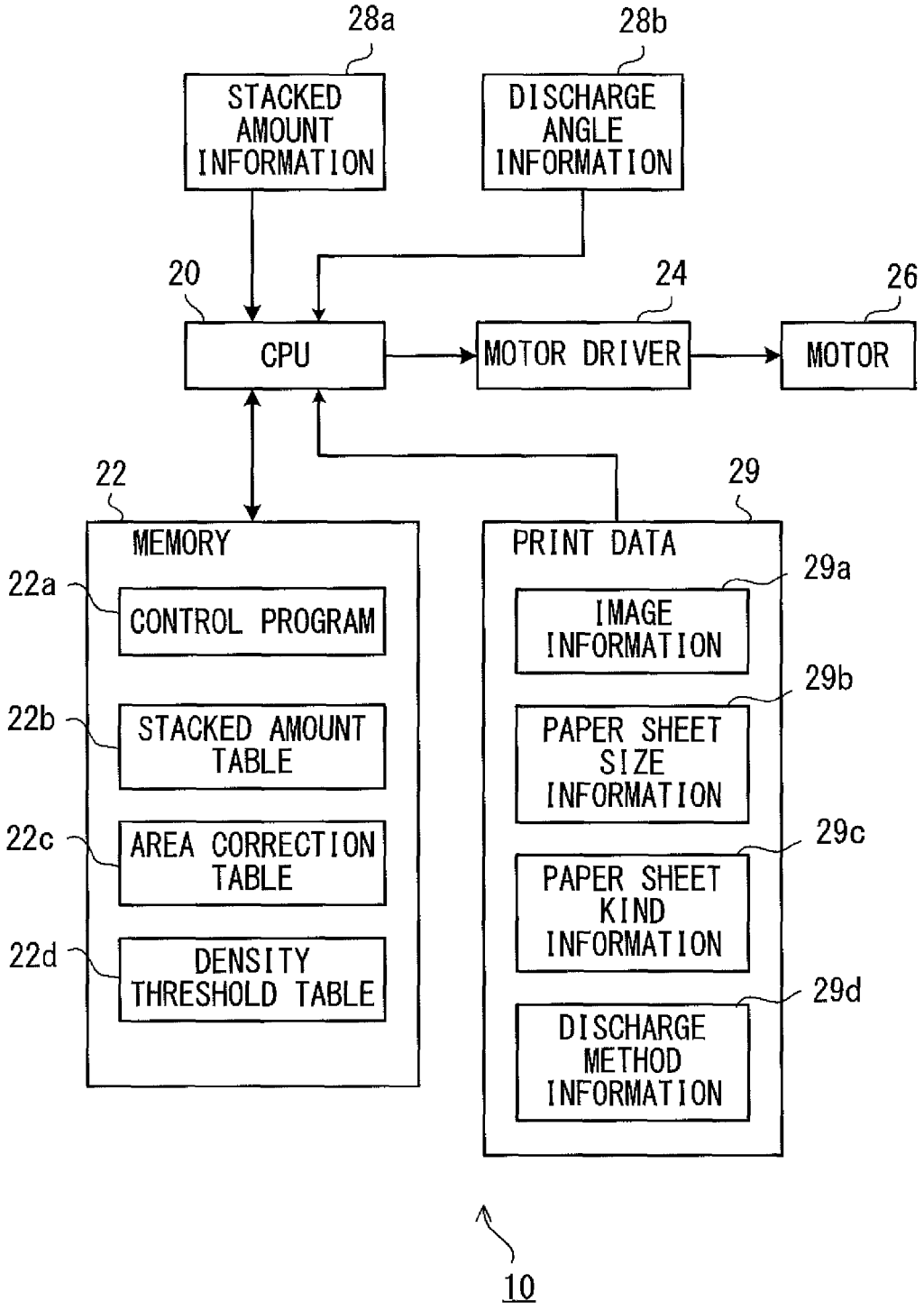
FIG. 4 is a block diagram of discharge angle control of the paper discharge device.

FIG. 4 is a block diagram related to discharge angle control of the paper discharge device 10. The paper discharge device 10 includes a CPU 20, a memory 22, a motor driver 24, and a motor 26.

The CPU 20 is a control unit that loads the control program 22*a* and controls the entirety of the paper discharge device 10. Note that the CPU 20 is not dedicated to the paper discharge device 10 and may also function as the CPU of the image forming device 1. The memory 22 is a non-volatile storage unit that stores a control program 22*a* that executes a control process of the paper discharge device 10 and various tables that are used for a discharge angle control process.

The motor driver 24 is configured to drive the motor 26 according to instructions from the CPU 20. The motor 26 is included in the discharge angle adjustment unit 44 and changes the angle of the discharge roller pair 42 by means of a drive signal from the motor driver 24. The motor 26 is, for example, a step motor and is rotated by an angle according to the input number of steps.

The CPU 20 calculates the discharge angle θ according to the various tables, stacked amount information 28*a*, discharge angle information 28*b*, print data 29, etc. The memory 22 stores as the various tables, a stacked amount table 22*b*, an area correction table 22*c*, and a density threshold table 22*d*.

The stacked amount table 22*b* is a table which defines the basic discharge angle θa that corresponds to the stacked amount according to the paper size and the discharge direction. The stacked amount table 22*b* is also referred to as a basic discharge angle table. FIGS. 5A and 5B are tables illustrating examples of the stacked amount table 22*b*. FIG. 5A is a diagram illustrating a table configuration. FIG. 5B indicates specific angles (sections in gray) with respect to some of the parameters in FIG. 5A. For example, when the paper size is A3, the discharge direction is the vertical (long side) direction, and the number of stacked paper sheets is 0-200 and the basic discharge angle θ00 (θa)=85.6°.

In other words, the stacked amount table 22*b* is a table which sets as the basic discharge angle θa a discharge angle such that it sets the contact start position G at which the front end of a paper sheet to be discharged comes into contact with a stacked paper sheet first at the reference position in the discharge direction of the stacked paper sheet, and defines the basic discharge angle θa according to the stacked amount and the paper sheet size.

As the length of the stacked paper sheet 210 in the discharge direction becomes greater, due to a paper sheet size etc., the basic discharge angle θa is set to be larger (in the upward direction to the downstream side), and as the stacked amount becomes larger, the basic discharge angle θa is set to be larger (in the upward direction to the downstream side).

Figure 6:
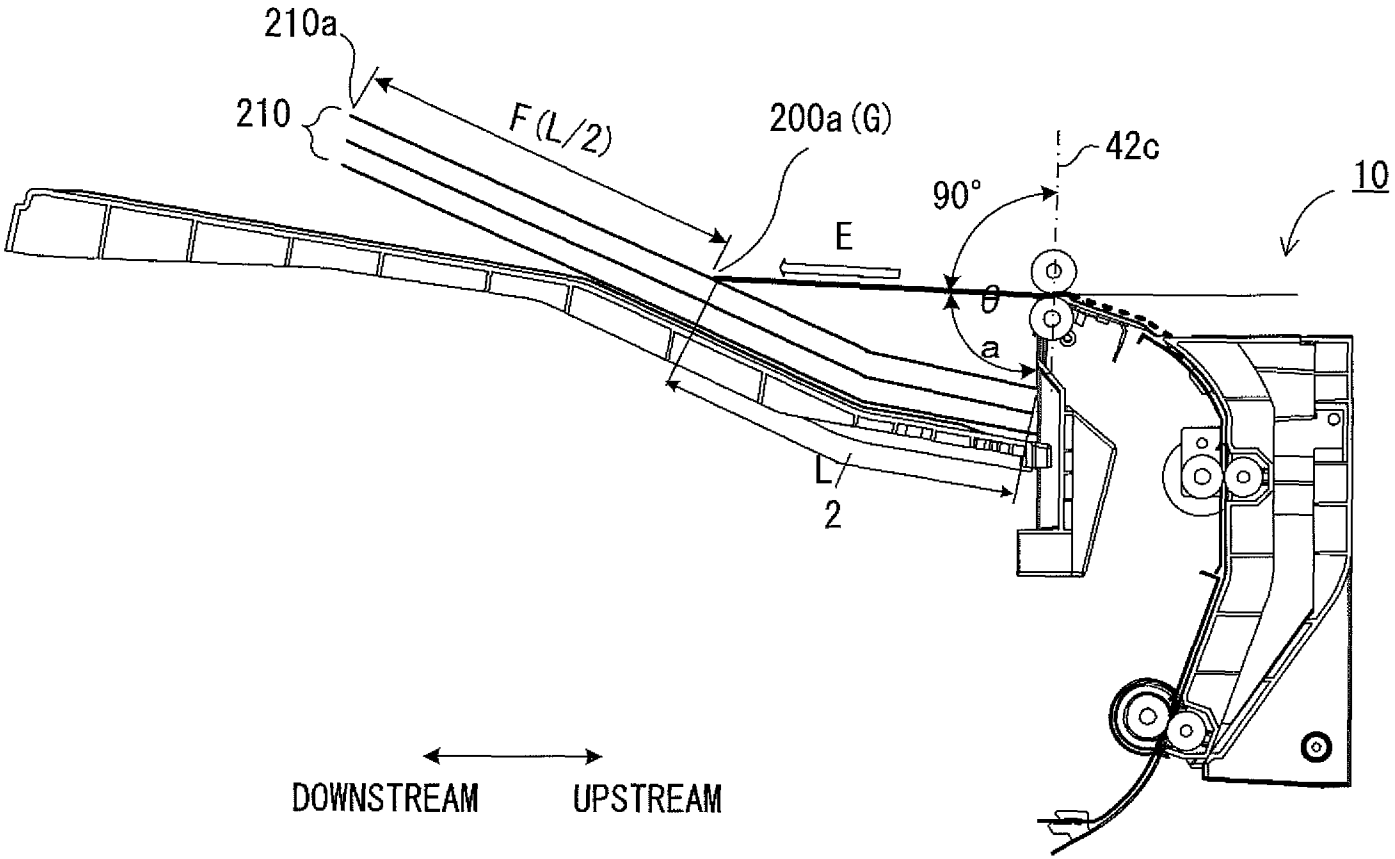
FIG. 6 is a diagram illustrating the fact that a basic discharge angle is set to be larger according to an increase in the stacked amount.

FIG. 6 is a diagram illustrating the fact that the basic discharge angle is set larger as the stacked amount increases. Since the contact start position G moves to the upstream side along with an increase in the stacked amount, it is necessary to increase the basic discharge angle θa in order to maintain the contact start position G at the reference position (L/2) of the stacked paper sheet 210. As illustrated in the example in FIG. 5A and FIG. 5B, when the number of stacked paper sheets changes from 0-200 to 401-500, ea is changed from 85.6° to 95.9°.

The area correction table 22*c* is a table which defines a correction value α for correcting the basic discharge angle θa. The area correction table 22*c* defines a correction value for changing the contact start position G from the reference position to an area that is detected according to image density so that printing is not stained. The area correction table 22*c* is provided to be associated with all the matrices (5×6=30) of the stacked amount table 22*b*. FIGS. 7A-7C and FIGS. 8A-8C are tables illustrating examples of the area correction table 22*c*.

Figures 7A, 7B, 7C:
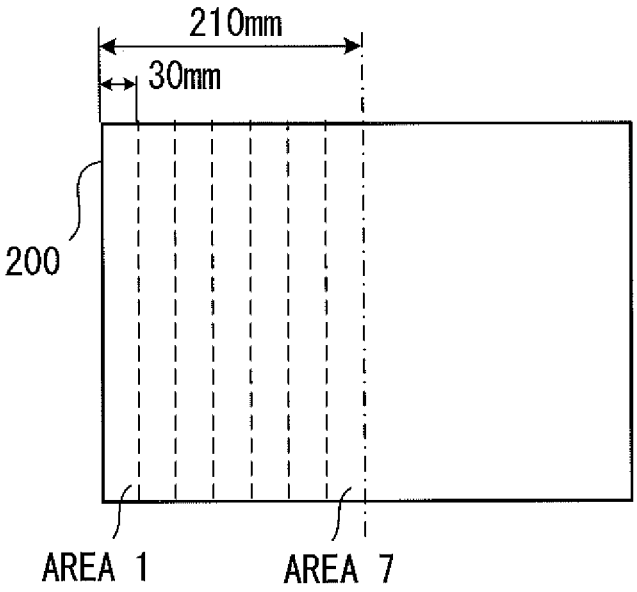
FIG. 7A is a diagram illustrating area divisions of an area correction table.
FIG. 7B is a table illustrating an example of the area correction table.
FIG. 7C is a table illustrating a specific example of the area correction table.

FIGS. 7A-7C illustrate examples of the area correction table 22*c* that corresponds to θ00 when the paper sheet size is A3 vertical and the number of stacked paper sheets is 0-200 in FIG. 5A. FIG. 7A is a diagram illustrating area divisions. The areas are obtained by dividing the image region of the image data on the paper sheet along the discharge direction. The image region may be a region obtained by excluding the edge of the paper sheet or may be the entirety of the sheet. In this example, the region from the center to the front end 200*a* of the paper sheet 200 is divided into seven areas at equal intervals. Since the length (L/2) from the center to the front end 200*a* is 210 mm, the width of one area is 30 mm. The areas are referred to as area 1, area 2 . . . in order from the front end 200*a*, and the last area is referred to as area 7.

FIG. 7B illustrates the area correction table 22*c* in which correction values α1-α7 corresponding to areas 1-7 are indicated. FIG. 7C indicates specific examples of correction values α1-α7. In a face-down situation, when area 3 is the area that is closest to the front end 200*a* from among the areas in which there is a high-density portion J, α3 (13.6°) is selected as a correction value. In a face-up situation, when area 4 is the area that is closest to the center from among the areas in which there are no high-density portions J, α5 (9.7°) is selected as a correction value. Details of correction value selection will be described in step S40 in the flowchart illustrated in FIG. 11B.

Figures 8A, 8B, 8C:
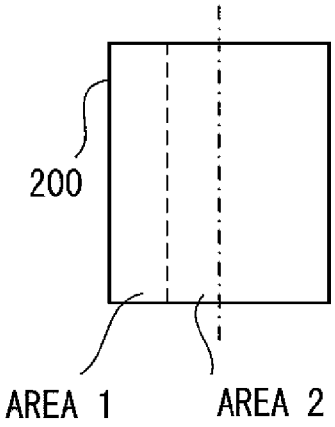
FIG. 8A is a diagram illustrating area divisions of the area correction table.
FIG. 8B is a table illustrating an example of the area correction table.
FIG. 8C is a table illustrating a specific example of the area correction table.

FIGS. 8A-8C illustrate examples of the area correction table 22*c* that corresponds to θ50 when the paper sheet size is B5 (the size defined by ISO 216, 182 mm×257 mm) horizontal and the number of stacked paper sheets is 0-200 in FIG. 5A. FIG. 8A is a diagram illustrating area divisions. In this example, the region from the center to the front end 200*a* of the paper sheet 200 is divided into two areas at equal intervals. As compared with the case of A3 vertical, since the paper sheet length L becomes shorter, the number of areas is reduced accordingly. The areas are referred to as area 1 and area 2 in order from the front end 200*a*. FIG. 8B illustrates the area correction table 22*c*, and correction values α163 and α164 that correspond to area 1 and area 2, respectively, are described therein. FIG. 8C indicates specific examples of correction values α163 and α164.

FIG. 9 is a table illustrating a specific example of the density threshold table 22*d*. Density threshold γ is a reference value for judging whether or not the density in each area is so high that print image quality deteriorates due to rubbing between paper sheets. That is, density threshold γ is a reference for judging whether or not it is a high-density portion J. The greater a density value is, the higher the density is.

In addition, since ink permeability changes depending on the kind of paper sheet, different thresholds are set for different kinds of paper sheets. For example, in the case of plain paper, it is indicated that in an area in which the maximum image density of the print image is less than 8, ink is less likely to blur even when the area is rubbed. In the case of thin paper, even when ink density is lower in comparison with the case of matte paper, etc., ink might blur when the paper is rubbed, and thus a density threshold γ of thin paper is set lower.

Figure 10:
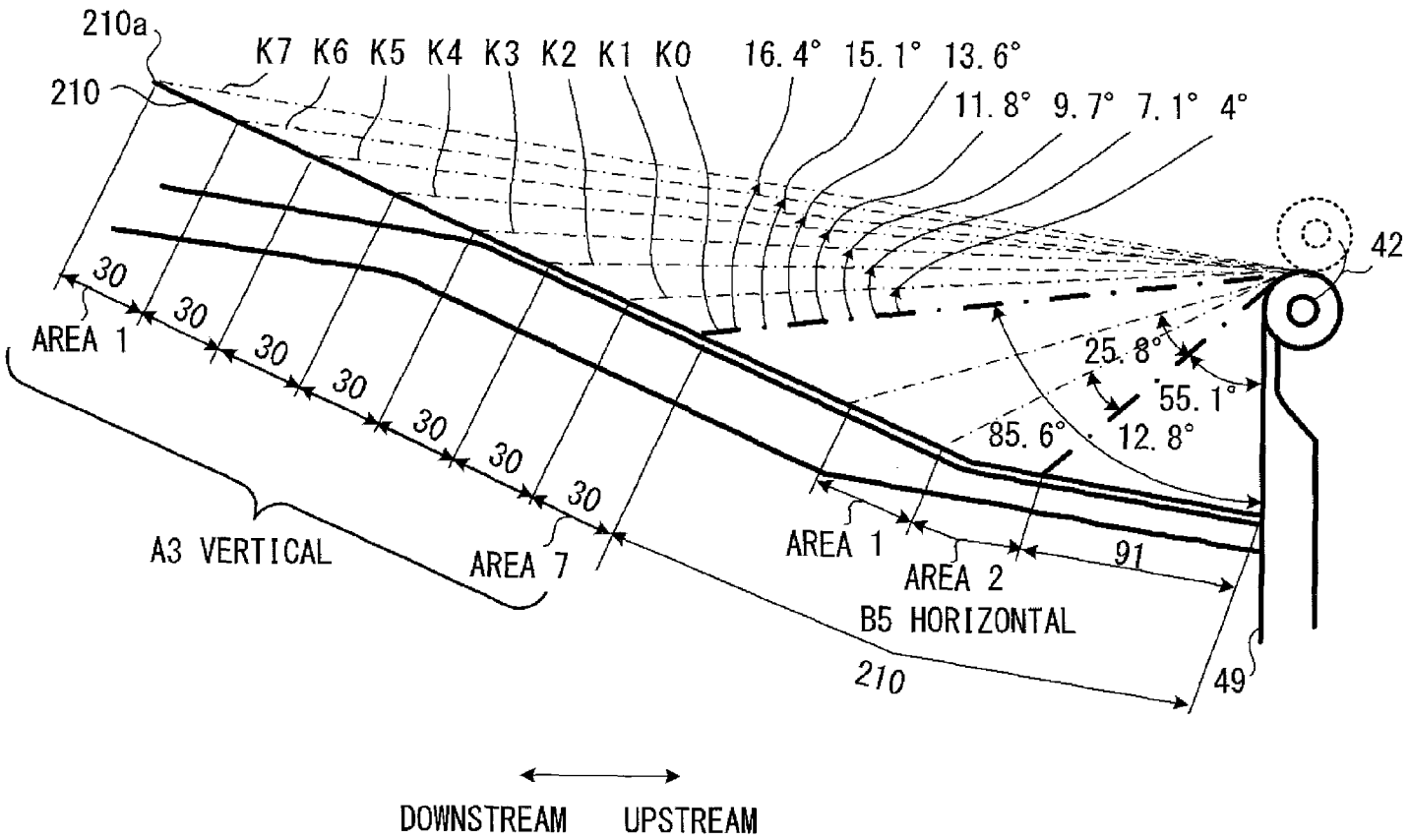
FIG. 10 is a diagram illustrating discharge angles corresponding to correction values of the areas illustrated in FIGS. 7 and 8.

FIG. 10 is a diagram illustrating side-by-side each position of the areas illustrated in FIGS. 7A-7C and FIGS. 8A-8C, and each locus of paper discharge corresponding to each area correction value. Areas 1-7 on the downstream side correspond to A3 vertical areas. Areas 1 and 2 closer to the upstream side correspond to B5 horizontal areas. Each discharge locus corresponding to each correction value α is illustrated with a dashed-dotted line. K0 (bold dashed-dotted line) is a discharge locus corresponding to the A3 vertical basic discharge angle θa. K1-K7 are discharge loca corresponding to A3 vertical correction values α1-α7.

Returning to FIG. 4, the stacked amount information 28*a* is height (stacked amount) information of stacked paper sheets 210 that are stacked on the paper discharge tray 30. The stacked amount information 28*a* is data for adjusting the discharge angle according to the stacked amount. The stacked amount information 28*a* may be an output of a stacked amount detecting sensor for detecting the uppermost face position of the stacked paper sheets 210, or may be an output of a sensor for detecting paper sheet passage in order to count the number of paper sheets.

The discharge angle information 28*b* is information on the inclination angle of the discharge roller pair 42. In the case in which the motor 26 is a step motor, the discharge angle information 28*b* is the number of steps input to the motor 26. In the case in which the motor 26 is a DC motor, etc., the discharge angle information 28*b* is an output of an encoder, etc. (not shown) for angle detection that is provided on the discharge roller pair 42.

The print data 29 includes image information 29*a*, paper sheet size information 29*b*, paper sheet kind information 29*c*, and discharge method information 29*d*. The print data 29 is given from the print unit, etc., of the image forming device 1.

The image information 29*a* is information for calculating the maximum image density on each area, and is obtained by using image information for printing as it is. The image information 29*a* is also referred to as image data. The paper sheet size information 29*b* is information for deciding the size and discharge direction (long side or short side) of a paper sheet 200 to be discharged. The paper sheet kind information 29*c* is information for deciding the kind of paper sheet that is indicated in the density threshold table 22*d* in FIG. 9. The discharge method information 29*d* is information for deciding whether the orientation of the print face of a paper sheet 200 to be discharged will be face down or face up.

The CPU 20 decides the basic discharge angle θa with reference to the stacked amount table 22*b* according to the paper sheet size information 29*b* and the stacked amount information 28*a*. The CPU 20 decides a density threshold γ with reference to the density threshold table 22*d* according to the paper sheet kind information 29*c*. The CPU 20 calculates the maximum image density on each area according to the image information 29*a*. The CPU 20 decides whether the orientation of the print face will be face down or face up according to the discharge method information 29*d*.

The CPU 20 compares the maximum image density on each area and density threshold γ, and decides correction value α. The CPU 20 adds correction value α to the basic discharge angle θa, and decides the discharge angle θ. The CPU 20 decides the inclination angle of the discharge roller pair 42 so that the discharge angle becomes the decided discharge angle θ, calculates the corresponding rotation amount of the motor 26, and notifies the motor driver 24 of the rotation amount. The motor driver 24 rotates the motor 26 by a specified amount, and the inclination angle of the discharge roller pair 42 is changed to the corresponding angle.

Figure 11A:
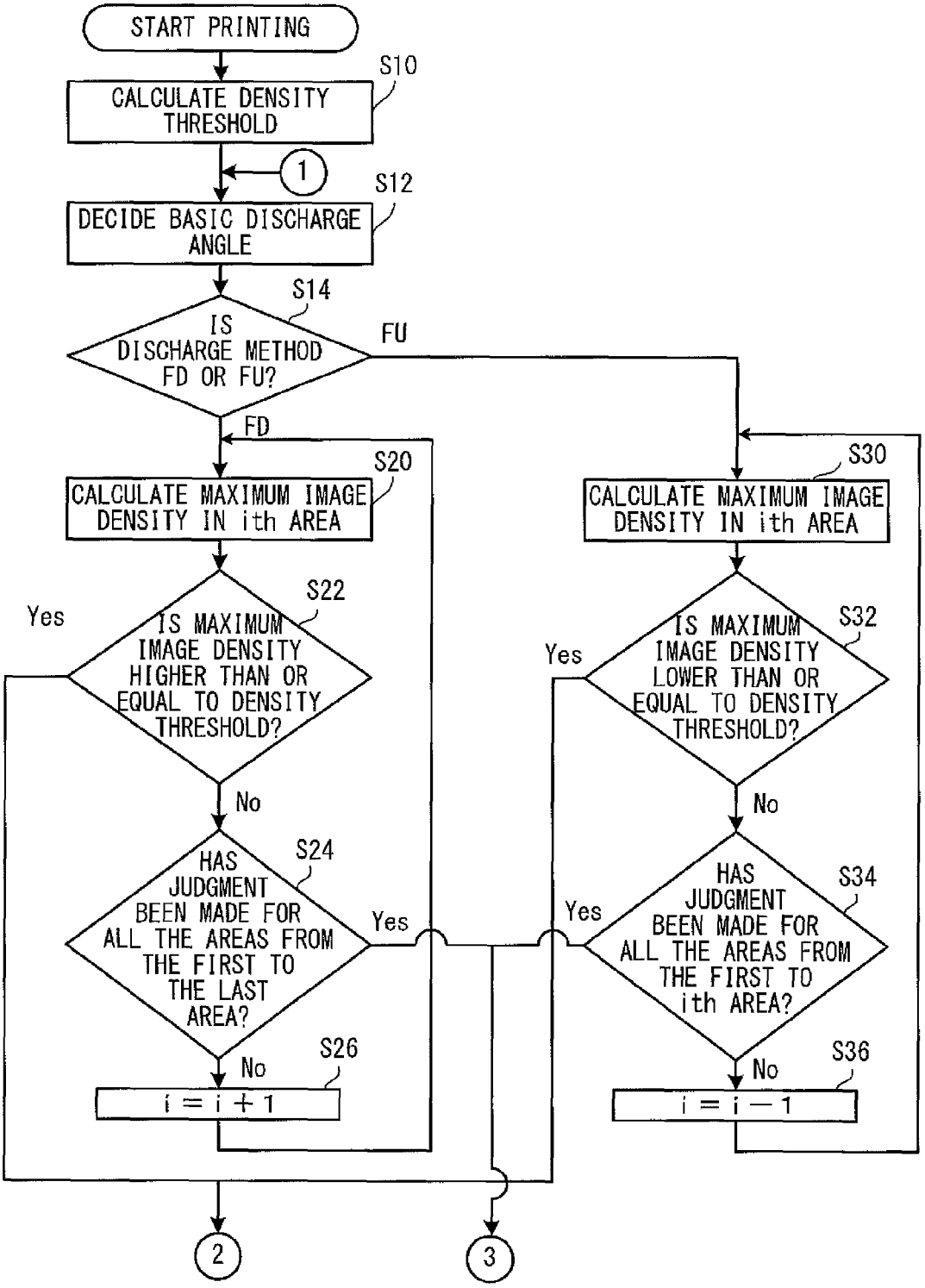
FIG. 11A is a flowchart 1 explaining discharge angle control procedures.
Figure 11B:
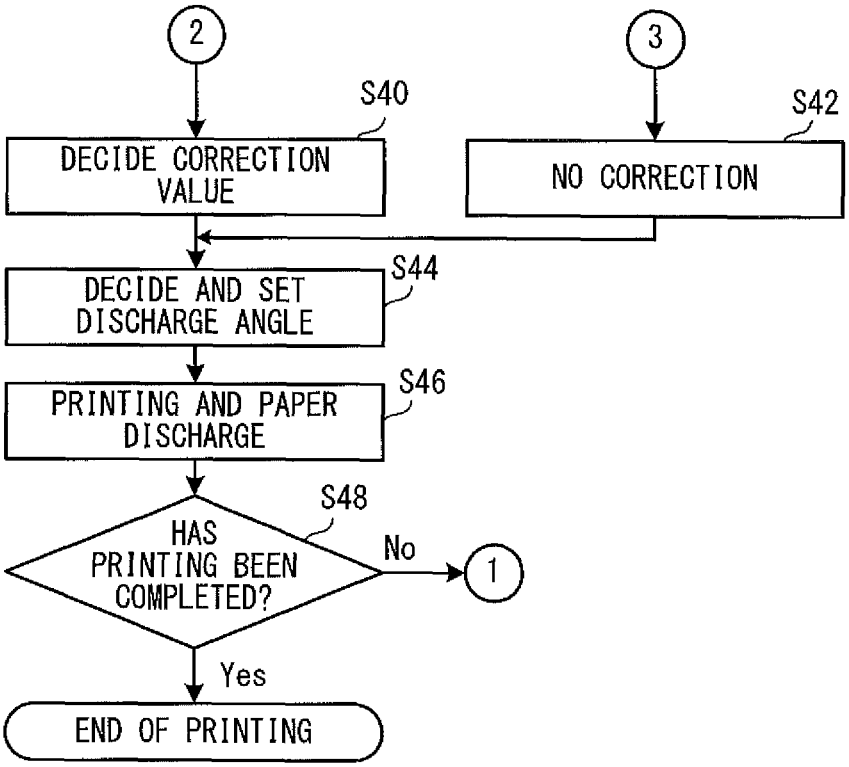
FIG. 11B is a flowchart 2 explaining discharge angle control procedures.

FIG. 11A is a flowchart 1 and FIG. 11B is a flowchart 2 for explaining procedures for discharge angle control. The discharge angle control is performed by the CPU 20.

The CPU 20 calculates density threshold γ from the paper sheet kind information 29*c* of the print data 29 with reference to the density threshold table 22*d* (step S10). The CPU 20 decides the basic discharge angle θa from the stacked amount information 28*a* and the paper sheet size information 29*b* with reference to the stacked amount table 22*b* (step S12). In addition, the CPU 20 decides whether the orientation of the print face will be face-down (FD) or face-up (FU) according to the discharge method information 29*d* (step S14).

When the CPU 20 decides that the orientation of the print face will be face-down (FD), the flow proceeds to step S20. The CPU 20 calculates the maximum image density in an ith area from the beginning, assuming the initial value of i=1 (step S20). The CPU 20 divides the area into specified blocks, calculates image density on each block, and sets the maximum density among the blocks as the maximum image density of the area.

The CPU 20 judges whether or not the maximum image density in the area concerned is higher than or equal to density threshold γ (step S22). When the CPU 20 judges that the maximum image density in the area concerned is not higher than or equal to than density threshold γ (No in step S22), the CPU 20 determines whether or not a judgment has been made on all the areas from the first to the last area (step S24). When the CPU 20 determines that the judgment has not been made on all the areas from the first to the last area (No in step S24), the CPU 20 sets i=i+1 (step S26), and returning to S20, makes a comparison in the next area.

When the CPU 20 determines that the judgment has been made on all the areas from the first to the last area (Yes in step S24), the CPU 20 determines that no correction will be made (α=0) (step S42) since the maximum image density in all the areas is lower than or equal to a density threshold γ.

On the other hand, when the CPU 20 judges that the maximum image density in the area concerned is higher than or equal to density threshold γ (Yes in step S22), the CPU 20 reads correction value α corresponding to the area concerned in which the maximum image density is higher than or equal to density threshold γ with reference to the area correction table 22*c*, and decides a correction value α of the discharge angle θ (step S40).

FIG. 12A is a table illustrating a specific example of decision of correction value α in a face-down situation. This example indicates the case in which the number of areas is 7, as illustrated in FIG. 7A. In addition, it is assumed that the kind of paper sheet is plain paper and the density threshold γ=8. The maximum image density in each area is calculated in ascending order from area 1, and is compared with density threshold γ. Up to area 2, the maximum image density is lower than density threshold γ (judgment ○). In area 3, the maximum image density is higher than or equal to density threshold γ=8 (judgment x). Therefore, α3 corresponding to area 3 is decided as a correction value. As a specific example, α=13.6° (FIG. 7C), and the discharge locus becomes K3 (FIG. 10).

Returning to step S14, when the CPU 20 decides that the orientation of the print face will be face-up (FU), the flow proceeds to step S30. The CPU 20 calculates the maximum image density in an ith area by setting the initial value to i=imax with respect to the uppermost paper sheet of the stacked paper sheets 210 (step S30). As described in FIGS. 3A-3C, since the uppermost paper sheet of the stacked paper sheets 210 might be stained due to rubbing in a face-up situation, in contrast to a face-down situation, the maximum image density of an area of the closest stacked paper sheet 210 is calculated instead of the paper sheet 200 to be discharged.

The CPU 20 judges whether or not the maximum image density in the area concerned is lower than or equal to density threshold γ (step S32). When the CPU 20 judges that the maximum image density in the area concerned is not lower than or equal to density threshold γ (No in step S32), the CPU 20 determines whether or not the judgment has been made on all the areas from the first to the lth area (step S34).

When the CPU 20 determines that the judgment has not been made on all the areas from the first to the lth area, which is the last (No in S34), the CPU 20 sets i=i−1 (step S36), the flow returns to step S30, and the CPU 20 makes a comparison in the next area.

When the CPU 20 determines that the judgment has been made on all the areas from the first to the lth area (Yes in step S34), since the maximum image density in all the areas is higher or equal to the density threshold γ, the CPU 20 decides that no correction will be made (α=0) (step S42).

FIG. 12B is a table illustrating a specific example of decision of correction value α in a face-up situation. Similarly to FIG. 12A, it is assumed that the number of areas is 7 and density threshold γ=8. The maximum image density in each area is calculated in descending order from area 7 and is compared with density threshold γ. Until area 5 is reached, the maximum image density is higher than or equal to density threshold γ (judgment x). In area 4, the maximum image density is lower than or equal to density threshold γ=8 (judgment ○). Therefore, α5 corresponding to area 5, which is one area before area 4, is decided as a correction value. As a specific example, α=9.7° (FIG. 7C), and a discharge line becomes K5 (FIG. 10).

Note that, in the above description, the line (K5) on the rear end side of area 4 is decided as a discharge locus since it is advantageous in terms of alignment of a discharged paper sheet that the discharge angle be closer to the basic discharge angle θa; however, the discharge locus may be set at the center position in area 4, that is, in the middle between K4 and K5. By setting the discharge locus at the middle position, errors in discharge angle may be absorbed.

Returning to FIG. 11B, the CPU 20 decides the discharge angle θ by adding correction value α to the basic discharge angle θa, and rotates the discharge roller pair 42 so that the discharge angle becomes the determined discharge angle θ (step S44). Note that when α=0 as indicated in step S42, θ=θa.

The CPU 20 performs printing and paper discharge after setting the determined discharge angle θ (step S46). The CPU 20 judges whether or not printing has been completed (step S48), and when the CPU 20 judges that printing has not been completed (No in step S48), the flow returns to step S12. When the CPU 20 judges that printing has been completed (Yes in step S48), the CPU 20 terminates this process.

<In Regard to Discharge Angle Adjustment Unit>

Figure 13:
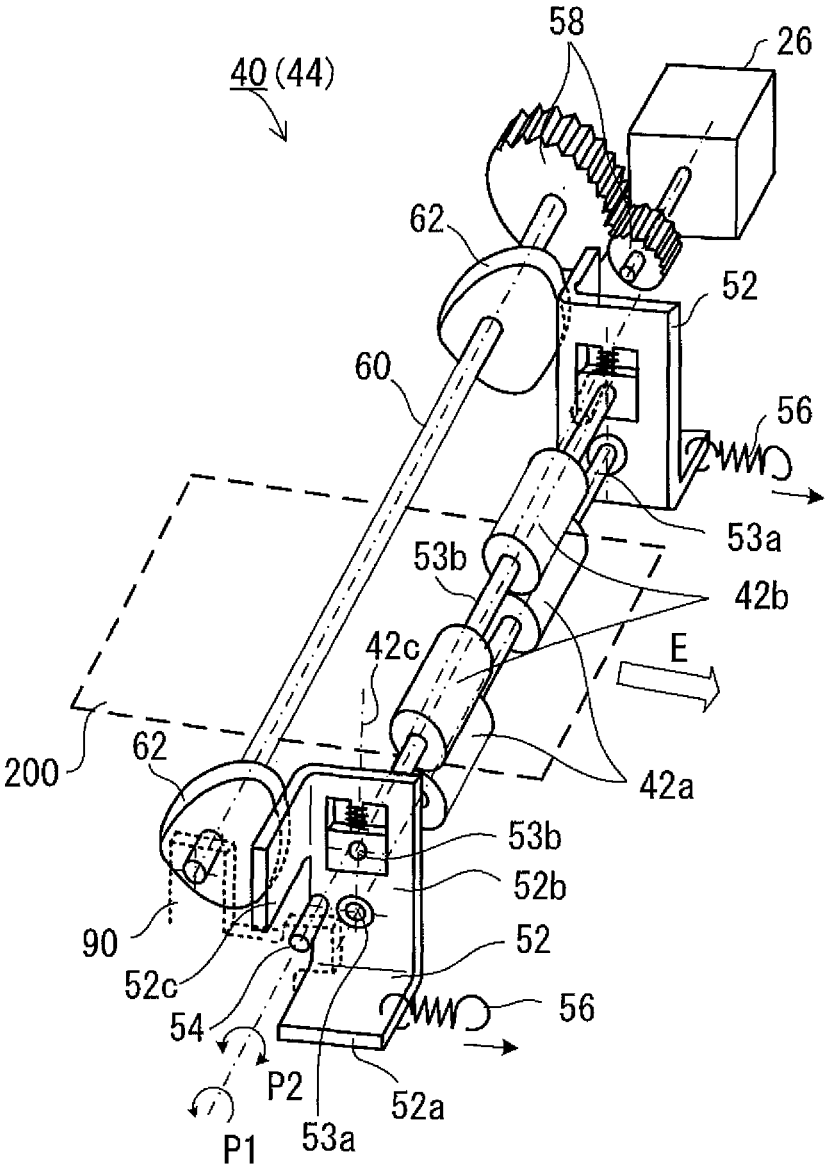
FIG. 13 is a first example of a discharge angle adjustment unit.

Hereinafter, a configuration of the discharge angle adjustment unit 44 will be described. FIG. 13 illustrates a first example of the discharge angle adjustment unit 44. The discharge angle adjustment unit 44 of the first example is configured to change the angle of discharge roller pair 42 by using cams. FIG. 13 is a perspective view of the discharge roller unit 40 seen from the direction in which the paper sheet 200 is discharged to the right.

The discharge roller unit 40 includes the discharge roller pair 42 and the discharge angle adjustment unit 44. Two discharge roller pairs 42 each composed of the drive roller 42*a* and the driven roller 42*b* are provided. A roller shaft 53*a* that supports the drive rollers 42*a* and the roller shaft 53*b* that supports the driven rollers 42*b* are provided. Roller frames 52 that rotate and support the roller shaft 53*a* and the roller shaft 53*b* are provided at the right and left ends.

The right and left roller frames 52 have symmetric shapes. The roller frame 52 includes a bottom section 52*a*, a shaft support section 52*b* that vertically extends from the bottom section 52*a* and supports the roller shaft 53*a* and the roller shaft 53*b*, and a side section 52*c* that is provided at the upper part of the shaft support section 52*b* and extends in parallel to the axial direction of the roller shaft 53*a*.

A frame shaft 54 is provided outward in the right and left directions near the roller shaft 53*a* of the shaft support section 52*b* of each of the right and left roller frames 52. The right and left frame shafts 54 are pivotally supported on abase member 90, part of which is illustrated with dotted lines. The base member 90 is fixed to the paper discharge device 10. One end of the energizing spring 56 is locked to the bottom section 52*a* of each of the right end left roller frames 52. The other end of the energizing spring 56 is locked to the base member 90. Thus, the discharge roller pairs 42 are rotatably supported by the base member 90 around the frame shafts 54, and are energized in the counterclockwise direction (P1 direction) around the frame shafts 54.

The motor 26 for changing the angle of the discharge roller pairs 42 is arranged near the roller frame 52. The motor 26 is fixed to the base member 90. A transmission unit 58 composed of a combination of a plurality of gears is provided on the output shaft of the motor 26, and two cams 62 that have the same shape are coupled to the transmission shaft 60 of the transmission unit 58. The transmission shaft 60 is rotatably supported by the base member 90.

The two cams 62 are provided at positions corresponding to the side sections 52*c* of the roller frames 52 at angles of the same phase. Since the roller frame 52 is energized in the P1 direction, the cam 62 comes into contact with the side section 52*c* of the roller frame 52.

According to the above configuration, the angle of the cam 62 is changed due to a specified rotation of the motor 26 that is driven by the motor driver 24, and the roller frame 52 correspondingly rotates in the P2 direction around the frame shaft 54, which is provided near the roller shaft 53*a*. The inclination angle of the discharge roller pair 42 is changed according to the rotation angle of the right and left roller frames 52.

Figure 14:
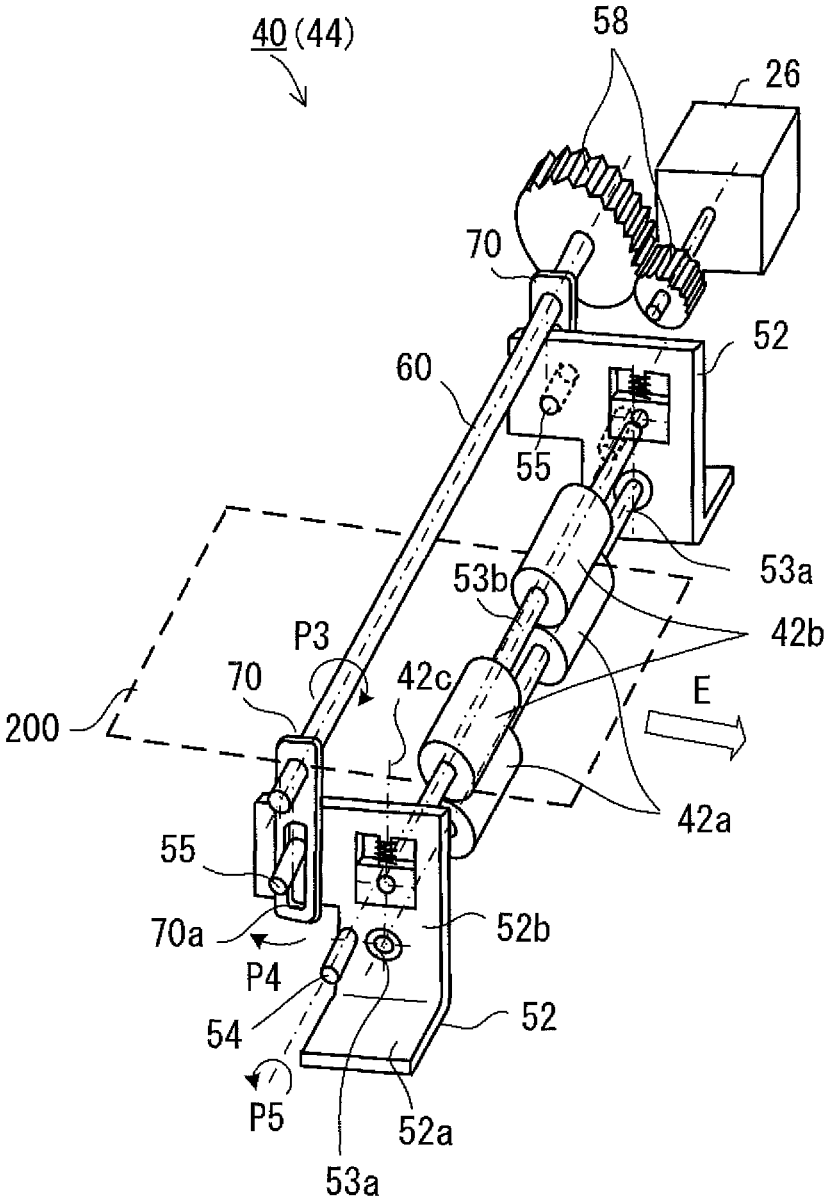
FIG. 14 is a second example of the discharge angle adjustment unit.

FIG. 14 is a second example of the discharge angle adjustment unit 44. The discharge angle adjustment unit 44 of the second example is configured to change the angle of the discharge roller pair 42 using links. Descriptions of the same portion as that in the first example will be omitted and a description will be given focusing on the points of difference.

Link pins 55 of the roller frames 52 are provided at the shaft support sections 52*b* of the right and left roller frames 52 in a direction parallel to the roller shaft 53*a*. Instead of the cam 62, one link 70 is provided at each of the right and left sides of the transmission shaft 60. The link 70 has an elongated shape and an elongated link groove 70*a* is formed inside thereof. The link 70 is provided fixed to the transmission shaft 60 and the link pin 55 is fitted to the link groove 70*a* of the link 70.

It is assumed that the transmission shaft 60 is rotated in the P3 direction due to rotation of the motor 26. The link 70 correspondingly rotates in the P4 direction around the transmission shaft 60. Rotation of the link 70 causes the link pin 55 that is fitted to the link groove 70*a* of the link 70 to move in the downward left direction, and in response to the movement of the link pin 55, the roller frame 52 rotates in the P5 direction. Thus, the angle of the discharge roller pair 42 is changed to an upward angle.

Next, another example of discharge angle adjustment means will be described. In the above embodiment, with respect to the discharge angle adjustment unit 44, a configuration that adjusts the discharge angle by changing the angle of the discharge rollers 42 has been described. However, discharge angle adjustment is not limited to this. Hereinafter, other discharge angle adjustment means will be briefly described.

Figure 15A:
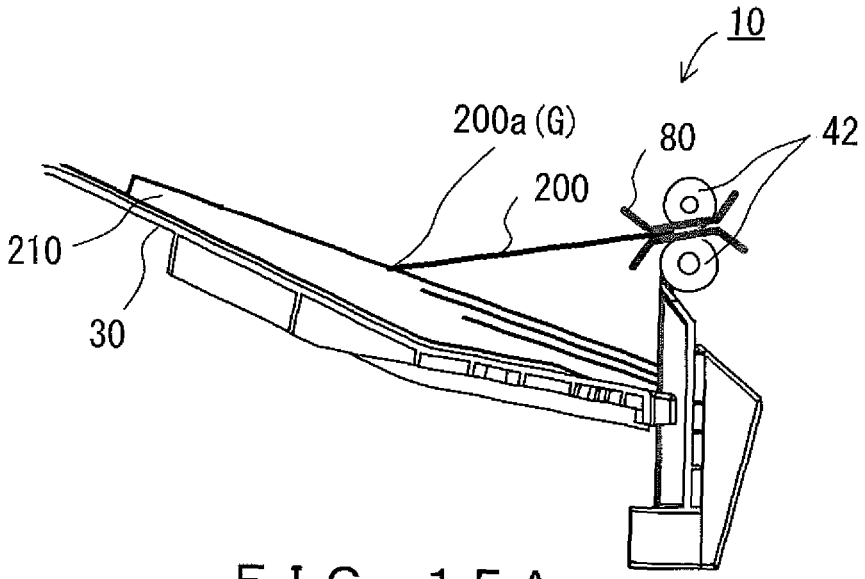
FIG. 15A is a first diagram illustrating an example of discharge angle adjustment performed by means of a paper discharge guide.
Figure 15B:
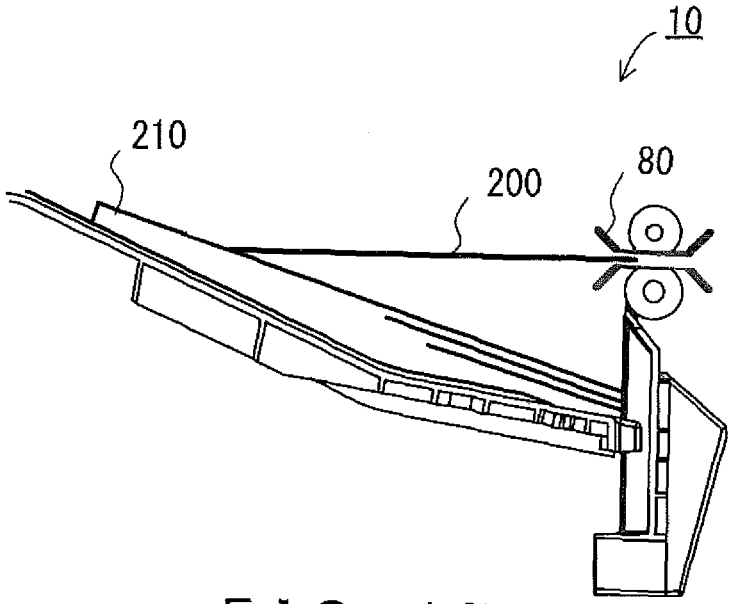
FIG. 15B is a second diagram illustrating an example of discharge angle adjustment performed by means of the paper discharge guide.

FIGS. 15A and 15B are diagrams illustrating examples of discharge angle adjustment that is performed by a paper discharge guide. The same portion as that in FIG. 1 is denoted by the same reference numeral and the description thereof will be omitted. FIG. 15A illustrates a state in which the contact start position G is set at an approximately center position, and FIG. 15B illustrates a state in which the discharge angle θ is set larger and the contact start position G is moved closer to the front end than those in FIG. 15A. The paper discharge guide 80 is provided at a discharge port and is configured to guide the paper sheet 200 to be discharged from the discharge roller pairs 42.

A discharge angle adjustment unit 44*a* adjusts the angle of the paper discharge guide 80 instead of the discharge roller pairs 42. The angle of the paper discharge guide 80 is adjusted via control that is performed by the CPU 20 according to the determined discharge angle θ. The mechanism of the discharge angle adjustment unit 44*a* may be made compact since fewer members are required in comparison with the case of rotating the discharge roller pairs 42.

Figure 16A:
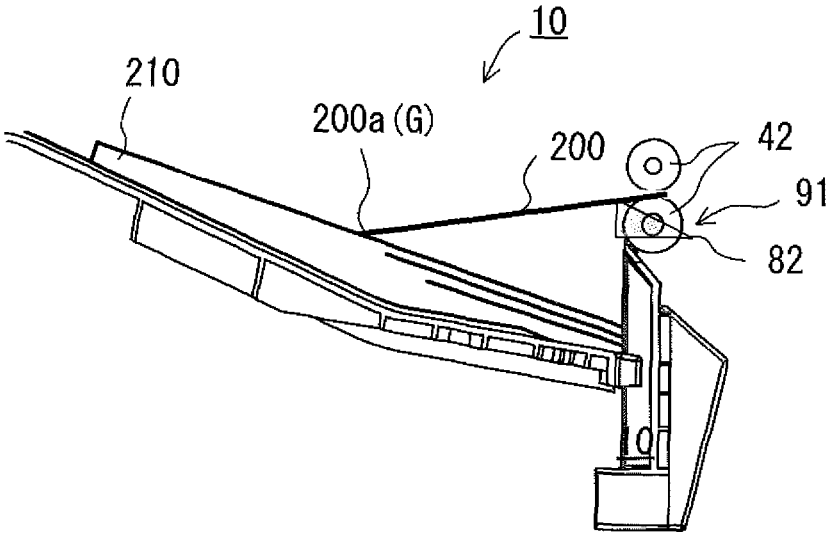
FIG. 16A is a first diagram illustrating an example of discharge angle adjustment performed by means of paper discharge wings.
Figure 16B:
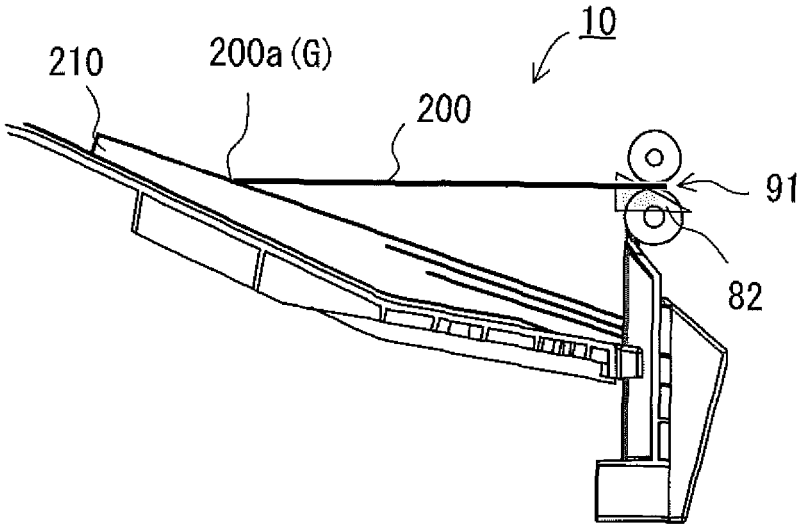
FIG. 16B is a second diagram illustrating an example of discharge angle adjustment performed by means of the paper discharge wings.

FIGS. 16A and 16B are diagrams illustrating examples of discharge angle adjustment that is performed by paper discharge wings. FIG. 16A illustrates a state in which the contact start position G is set at an approximately center position, and FIG. 16B illustrates a state in which the discharge angle θ is set larger and the contact start position G is moved closer to the front end than those in FIG. 16A. The paper discharge wings 82 are provided at the right and left of the discharge port, and are configured to guide the right and left sides of the paper sheet 200 to be discharged from the discharge roller pairs 42.

A position adjustment unit 91 is provided to adjust the vertical position of the paper discharge wing 82. The position of the paper discharge wing 82 is adjusted via control that is performed by the CPU 20 according to the determined discharge angle θ. The mechanism of the position adjustment unit 91 may be made compact since fewer members are required in comparison with the case of rotating the discharge roller pairs 42.

Figure 17A:
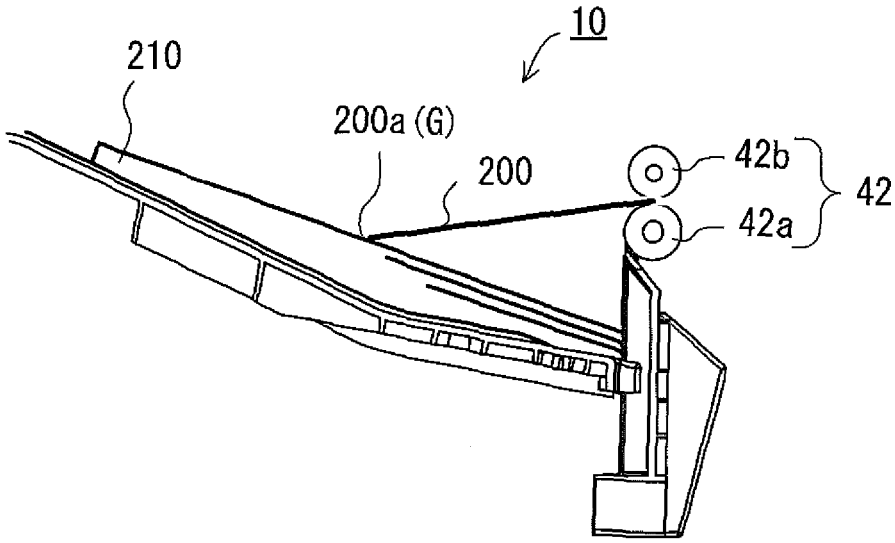
FIG. 17A is a first diagram illustrating an example of discharge angle adjustment performed by means of a driven roller.
Figure 17B:
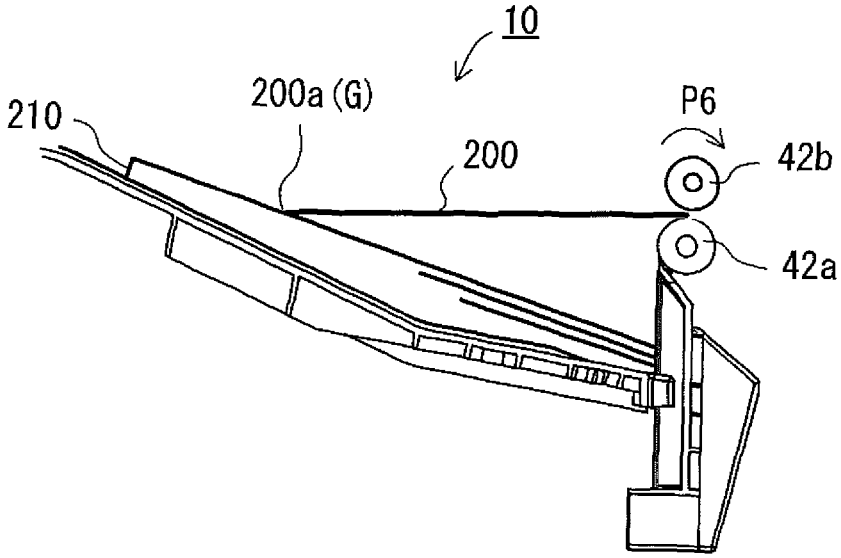
FIG. 17B is a second diagram illustrating an example of discharge angle adjustment performed by means of the driven roller.
Figure 18A:
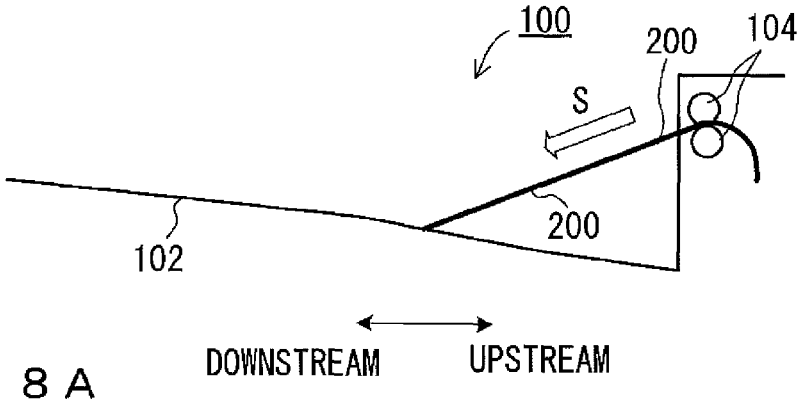
FIG. 18A is a first diagram illustrating as a conventional example a paper discharge device that makes the front end of a discharged paper sheet come into contact with stacked paper sheets.
Figure 18B:
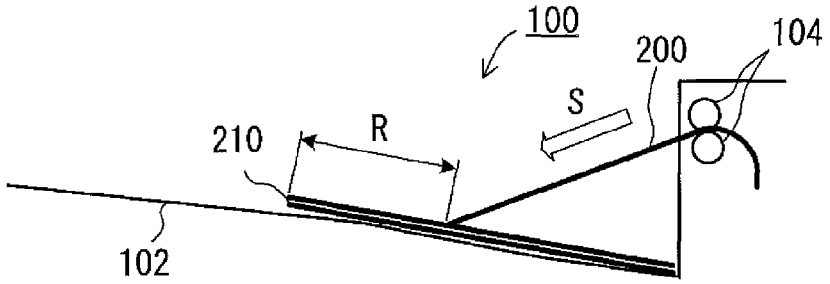
FIG. 18B is a second diagram illustrating as a conventional example the paper discharge device that makes the front end of a discharged paper sheet come into contact with stacked paper sheets.
Figure 18C:
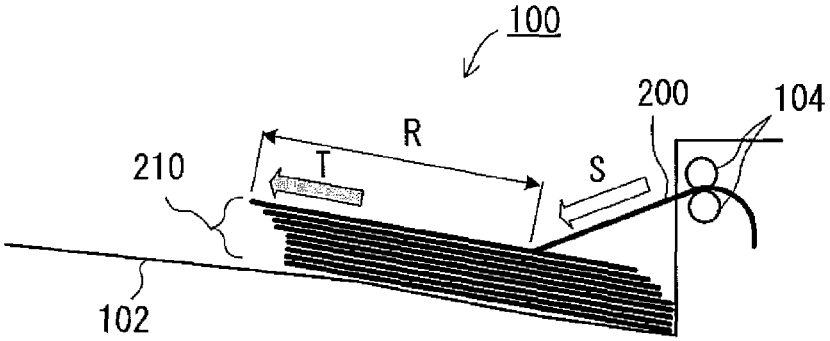
FIG. 18C is a third diagram illustrating as a conventional example the paper discharge device that makes the front end of a discharged paper sheet come into contact with stacked paper sheets.
Figure 19A:
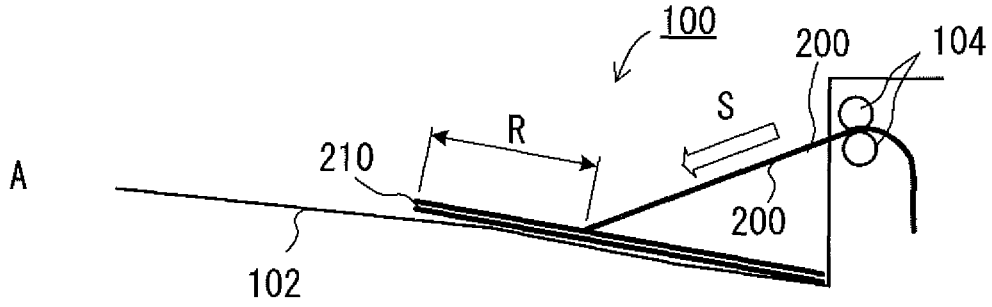
FIG. 19A is a first diagram illustrating as a conventional example how alignment of discharged paper sheets deteriorates when the size of a paper sheet is larger.
Figure 19B:
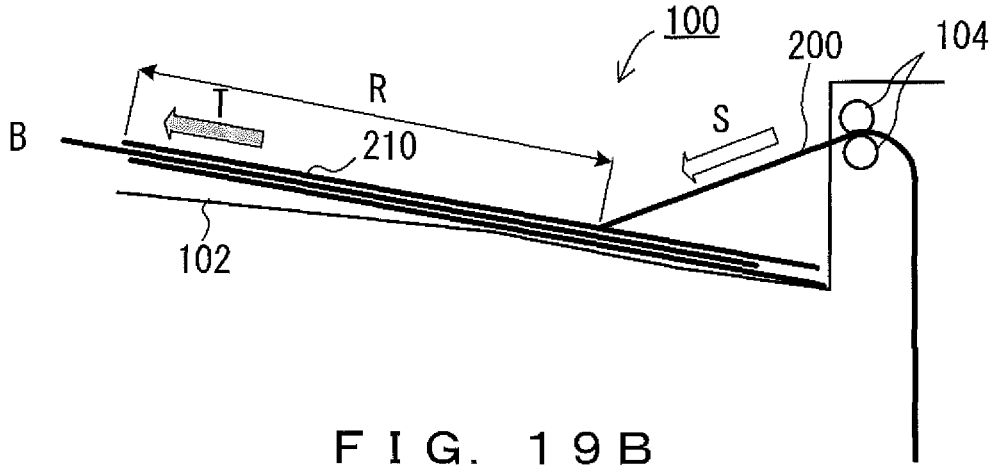
FIG. 19B is a second diagram illustrating as a conventional example how alignment of discharged paper sheets deteriorates when the size of a paper sheet is larger.
Figure 20A:
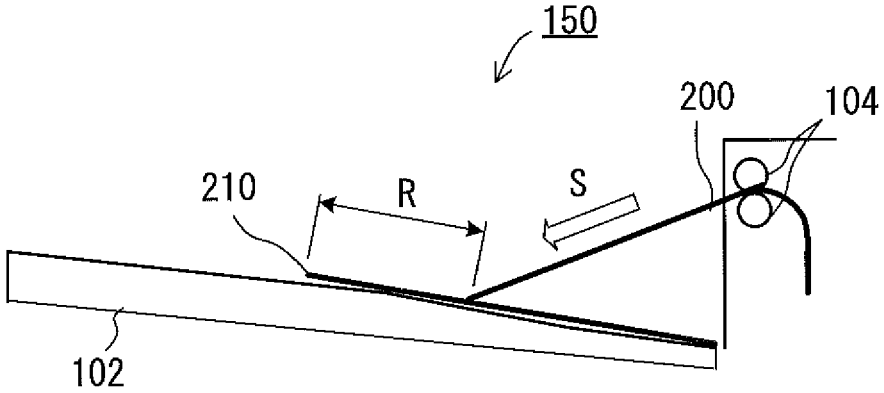
FIG. 20A is a first diagram illustrating as a conventional example a paper discharge device that lowers a paper discharge tray according to the stacked amount.
Figure 20B:
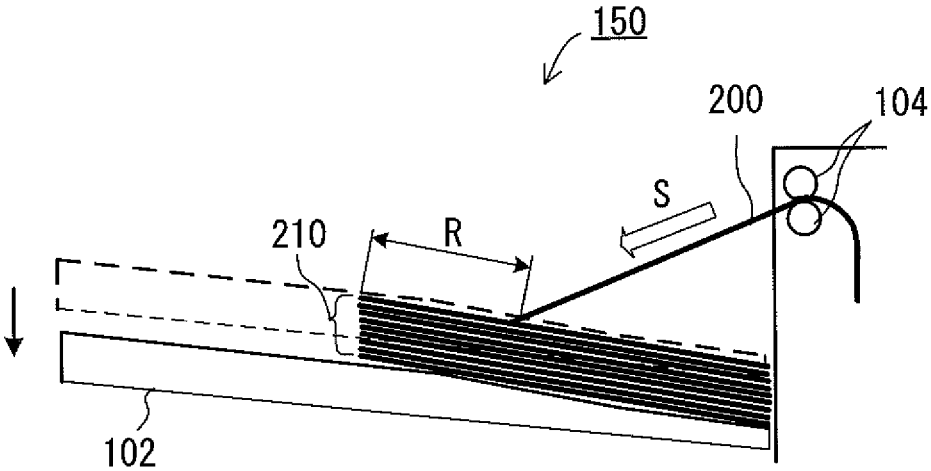
FIG. 20B is a second diagram illustrating as a conventional example the paper discharge device that lowers the paper discharge tray according to the stacked amount.

FIGS. 17A and 17B are diagrams illustrating examples of discharge angle adjustment that is performed by the driven roller. FIG. 17A illustrates a state in which the contact start position G is set at an approximately center position, and FIG. 17B illustrates a state in which the discharge angle θ is set larger and the contact start position G is moved closer to the front end than those in FIG. 17A.

A discharge angle adjustment unit 44*b* is provided to adjust the angle of the driven roller 42*b*. In the example in FIG. 1, etc., the entirety of the discharge roller pair 42 is rotated; however, in the examples in FIGS. 17A and 17B, the pressing angle of the driven roller 42*b* with respect to the drive roller 42*a* is changed without changing the position of the drive roller 42*a*. That is, the nip point N is moved to the upstream side.

The discharge angle adjustment unit 44*b* has a mechanism that is illustrated in FIGS. 13 and 14, and adjusts the pressing angle of the driven roller 42*b* instead of the entirety of the discharge roller pair 42. In the example in FIG. 17B, the driven roller 42*b* is rotated in the P6 direction, and the discharge angle is directed upward. The rotation mechanism of the discharge angle adjustment unit 44*b* may be made compact since the discharge angle adjustment unit 44*b* rotates only the driven roller 42*b* in comparison with the case of rotating the discharge roller pair 42.

According to the above-described embodiments, at least the following effects are obtained.

1 Since the discharge angle is changed so that the front end of a paper sheet to be discharged is discharged in contact with a stacked paper sheet and so that a portion with a high print density is not rubbed, quality degradation of printed matter may be prevented while alignment accuracy of discharged paper sheets is maintained.

2 Since an appropriate process is performed according to the orientation of paper discharge, whether the orientation of paper discharge is face-down or face-up, quality degradation of printed matter may be prevented.

3 In a face-down situation, since the discharge angle is set so that an area in which a high-density image is formed on a paper sheet to be discharged does not rub the back face of a stacked paper sheet, quality degradation of printed matter may be prevented.

4 In a face-up situation, since the discharge angle is set so that the front end of a paper sheet to be discharged does not rub an area in which a high-density image is formed on a stacked paper sheet, quality degradation of printed matter may be prevented.

5 Since a density threshold is set according to the kind of paper sheet, quality degradation of printed matter may be appropriately prevented according to a paper sheet.

6 Since the stacked amount table, which defines basic discharge angles so that the contact start position G is located at a specified position according to the stacked amount and the paper sheet size, and the area correction table, which corrects each basic discharge angle θa according to the position of the maximum image density, are prepared, and the final discharge angle θ is decided by using a combination of the basic discharge angle θa and its correction value α, a process for determining the discharge angle θ can flexibly adapt to a change in the stacked amount or the paper sheet size.

In addition, the following modifications are possible for the above embodiments.

1 In a face-up situation, the area for deciding a correction value, in which image density is lower than a threshold, may not necessarily be the area closest to the center position. This is because even though the area is not closest to the center, as long as the area of the stacked paper sheet that comes into contact with the front end of the paper sheet to be discharged is an area with a low image density, image degradation due to rubbing in a face-up situation may be prevented.

2 The reference position for the contact start position G is not limited to L/2, but for example, may be a position at about L/3 from the front end of a paper sheet.

3 An example in which discharge angle control is realized via a software process that is performed by the CPU 20 that loads the control program has been described; however, the control unit may be configured of hardware in part or whole thereof.

Note that the present invention is not limited to the above-described embodiments as they are, but may be embodied by deforming constituents within a scope not deviating from the gist of the invention at an execution step. In addition, various inventions can be made by appropriately combining a plurality of constituents that have been disclosed in the above embodiments. For example, all the constituents that have been disclosed in the embodiments may be appropriately combined. Further, constituents in different embodiments may be appropriately combined. It should be understood that various modifications and applications can be made without departing from the scope and the spirit of the invention.

EXPLANATIONS OF LETTERS OF NUMERALS

1 Image forming device
10 Paper discharge device
20 CPU
22 Memory
22*a* Control program
22*b* Stacked amount table
22*c* Area correction table
22*d* Density threshold table
24 Motor driver
26 Motor
28*a* Stacked amount information
28*b* Discharge angle information
29 Print data
29*a* Image information
29*b* Paper sheet size information
29*c* Paper sheet kind information
29*d* Discharge method information
30 Paper discharge tray
40 Discharge roller unit
42 Discharge roller pair
42*a* Drive roller
42*b* Driven roller
44 Discharge angle adjustment unit
49 Abutting face

200 Paper sheet
210 Stacked paper sheet

What is claimed is:

1. A paper discharge device that discharges and stacks paper sheets on which images are formed according to image data, the paper discharge device comprising:

a discharge roller that discharges the paper sheets;

a discharge angle adjustment unit that adjusts a discharge angle of the discharge roller; and a control unit that is configured to identify a paper sheet to be discharged on which an image is formed facing downward, divide an image region of image data on the identified paper sheet into areas along a discharge direction, determine an area in which a maximum image density related to the formed image for each divided area is higher than or equal to a specified threshold, and control the discharge angle adjustment unit so that the discharge angle of the discharge roller becomes a specific discharge angle such that the determined area is prevented from coming into contact with an already stacked paper sheet until the identified paper sheet to be discharged has been discharged from the discharge roller.

2. The paper discharge device according to claim 1, wherein the control unit is further configured to judge whether or not the maximum image density is higher than or equal to the specified threshold in order from an area on a front end side in the discharge direction on the image region of the image data of the identified paper sheet, and detect as an area in which the maximum image density is higher than or equal to the specified threshold a first area for which it is judged that the maximum image density is higher than or equal to the specified threshold.

3. The paper discharge device according to claim 1, wherein the control unit is further configured to change the specified threshold according to a kind of the paper sheet.

4. A paper discharge device that discharges and stacks paper sheets on which images are formed according to image data, the paper discharge device comprising:

a discharge roller that discharges the paper sheets;

a discharge angle adjustment unit that adjusts a discharge angle of the discharge roller; and a control unit that is configured to of identify a paper sheet to be discharged on which an image is formed facing upward, divide an image region of image data on an uppermost already stacked paper sheet into areas along a discharge direction, determine from among the divided areas an area in which a maximum image density related to the formed image is lower than or equal to a specified threshold based on the image data, and control the discharge angle adjustment unit so that the discharge angle of the discharge roller becomes a specific discharge angle such that a front end of the identified paper sheet to be discharged is brought into contact with the determined area of the uppermost already stacked paper sheet first.

5. The paper discharge device according to claim 4, wherein the control unit is further configured to judge whether or not the maximum image density is lower than or equal to the specified threshold in order from an area on a rear end side in the discharge direction on the image region of the image data of the uppermost already stacked paper sheet, and detect as an area in which the maximum image density is lower than or equal to the specified threshold a first area for which it is judged that the maximum image density is lower than or equal to the specified threshold.

6. The paper discharge device according to claim 4, wherein the control unit is further configured to change the specified threshold according to a kind of the paper sheet.

* * * * *